US010777182B2

(12) United States Patent
Semken

(10) Patent No.: US 10,777,182 B2
(45) Date of Patent: Sep. 15, 2020

(54) BELL AND A METHOD OF DESIGNING A BELL

(71) Applicant: JOHN TAYLOR BELL FOUNDRY (LOUGHBOROUGH) LIMITED, Loughborough (GB)

(72) Inventor: Michael John Semken, Loughborough (GB)

(73) Assignee: John Taylor Bell Foundry (Loughborough) Limited, Leicestershire (GB)

( * ) Notice: Subject to any disclaimer, the term of this patent is extended or adjusted under 35 U.S.C. 154(b) by 0 days.

(21) Appl. No.: 16/661,091

(22) Filed: Oct. 23, 2019

(65) Prior Publication Data

US 2020/0126530 A1 Apr. 23, 2020

(30) Foreign Application Priority Data

Oct. 23, 2018 (GB) ..... 1817223.9

(51) Int. Cl.
*G10K 1/30* (2006.01)
*G10K 1/32* (2006.01)

(52) U.S. Cl.
CPC ..... *G10K 1/30* (2013.01)

(58) Field of Classification Search
CPC ..... G10K 1/30; G10K 1/32
See application file for complete search history.

(56) References Cited

U.S. PATENT DOCUMENTS 296,515 A * 4/1884 Bowers ..... G10K 3/00 116/148
1,918,551 A * 7/1933 Merrill ..... G10K 1/32 116/148

(Continued)

FOREIGN PATENT DOCUMENTS

EP 0196720 A1 10/1986
EP 1120773 A2 8/2001

(Continued)

OTHER PUBLICATIONS

Lehr'S 1965 Paper, "The Sound of Bells", http://www.hibberts.co.uk/lehr.htm, 20 pages, accessed dated Oct. 14, 2019.

(Continued)

*Primary Examiner* — Robert W Horn
(74) *Attorney, Agent, or Firm* — McKee, Voorhees & Sease, PLC

(57) ABSTRACT

A bell including an outside surface, inside surface, lip at the bottom of the bell, sound bow above the lip, waist above the sound bow; above the waist a shoulder having a diameter equal to: 0.55*LD ±5%, and crown at the top of the bell above the shoulder; wherein a portion of the inside surface generally adjacent the shoulder has a first end at or near the crown; a second end at or near the waist and a inflection point generally in-between the first and second ends; as the inside surface portion extends away from the first end towards the point of inflection, the portion extends away from the crown more than it extends towards the outside surface; and as the inside surface portion extends towards the second end from the point of inflection, the portion extends towards the outside surface more than it extends away from the crown.

16 Claims, 38 Drawing Sheets

(56) References Cited

U.S. PATENT DOCUMENTS

| | | | | | |
|---|---|---|---|---|---|
| 2,811,071 | A * | 10/1957 | Gorr | G10D 13/09 | 84/406 |
| 3,683,845 | A * | 8/1972 | Doggart | G10K 1/063 | 116/148 |
| 3,760,482 | A * | 9/1973 | Kawamura | G04C 3/107 | 29/896.22 |
| 6,915,756 | B1 * | 7/2005 | McLachlan | G10K 1/071 | 116/148 |
| 10,424,278 | B2 * | 9/2019 | Hillis | G10D 13/08 | |
| 2012/0304846 | A1 * | 12/2012 | McLachlan | G10K 1/071 | 84/406 |
| 2020/0126530 | A1 * | 4/2020 | Semken | G10K 1/30 | |

FOREIGN PATENT DOCUMENTS

| | | | |
|---|---|---|---|
| EP | 1414020 | A2 | 4/2004 |
| JP | 3154098 | A | 7/1991 |
| WO | 2011067730 | A1 | 6/2011 |

OTHER PUBLICATIONS

Mclachlan et al., "The design of bells with harmonic overtones", J. Acoust. Soc. Am., vol. 114(1), pp. 505-511, Jul. 2003.

Intellectual Property Office, "Search Report" in connection with GB1817223.9 dated Oct. 23, 2018, 8 pages, dated Feb. 26, 2019.

Intellectual Property Office, "Search Report" in connection with GB1817223.9 dated Oct. 23, 2018, 3 pages, dated Oct. 9, 2019.

* cited by examiner

BELL AND A METHOD OF DESIGNING A BELL

CROSS-REFERENCE TO RELATED APPLICATIONS

This is a U.S. Application which claims priority to GB1817223.9, filed Oct. 23, 2018, which is herein incorporated by reference in its entirety.

FIELD

This specification discloses a bell and a method of designing a bell. The specification also discloses a plurality of such bells, a carillon including such bells, moulds for making such bells and a CAD file for storing the design of such a bell.

BACKGROUND

Bells have been made and used for millennia. They are often used in ceremonies; to mark times of the day; and are also used as musical instruments. One such musical instrument is called a carillon. A carillon is a musical instrument which is typically housed in a bell tower of a church or municipal building. A carillon typically includes at least 23 bells which are struck by clappers. The clappers are operated by a set of keys, called batons, which are connected to the clappers by a series of levers and wires. The bells in a carillon range in size to produce the different notes necessary to form a musical tune. A problem associated with this is that the smaller bells are not as loud as the larger bells and thus cannot be heard as clearly as the larger bells.

Bells produce more than one frequency when they are struck, five of which are the most dominant. A more pleasing sound profile for the bell can be achieved by ensuring that each of these frequencies can be heard. However, these frequencies are often out of tune with the dominant frequency and thus many bells are designed to prevent the other frequencies from sounding. By out of tune, we mean that the frequencies of the bell are not harmonically tuned meaning that the frequencies produced by the bell do not harmonise with each other. Thus, a problem associated with existing bells is making a bell which includes the five frequencies and which are harmonised and which can be heard.

It is a non-exclusive object of the present disclosure to ameliorate one or both of these problems.

SUMMARY

There is provided a bell including:

an outside surface which defines an exterior of the bell;

an inside surface which defines an interior of the bell;

a lip positioned at a bottom of the bell;

a sound bow positioned above the lip;

a waist positioned above the sound bow;

a shoulder positioned above the waist, having a shoulder diameter; and a crown positioned at a top of the bell above the shoulder;

wherein a portion of the inside surface generally adjacent the shoulder has a first end at or near the crown; a second end at or near the waist and a point of inflection generally in-between the first and second ends;

wherein as the portion of the inside surface extends away from the first end towards the point of inflection the portion extends away from the crown more than it extends towards the outside surface;

wherein as the portion of the inside surface extends towards the second end from the point of inflection the portion extends towards the outside surface more than it extends away from the crown;

and wherein the shoulder diameter (SD) is equal to:

$$SD=0.55*LD \pm 5\%.$$

There is also provided a bell including:

an outside surface which defines an exterior of the bell;

an inside surface which defines an interior of the bell;

a lip positioned at a bottom of the bell;

a sound bow positioned above the lip;

a waist positioned above the sound bow;

a shoulder positioned above the waist; and a crown positioned at a top of the bell above the shoulder;

wherein a portion of the inside surface generally adjacent the shoulder has a first end at or near the crown; a second end at or near the waist and a point of inflection generally in-between the first and second ends;

wherein as the portion of the inside surface extends away from the first end towards the point of inflection the portion extends away from the crown more than it extends towards the outside surface;

wherein as the portion of the inside surface extends towards the second end from the point of inflection the portion extends towards the outside surface more than it extends away from the crown;

and wherein a thickness of the shoulder, measured on a horizontal axis from the outside surface to a central axis of the bell passing through the point of inflection is at least 10% of the shoulder diameter.

The point of inflection may be positioned substantially halfway between the first and second ends.

The portion between the first end and the point of inflection may extend curvilinearly away from the first end inwardly away from the outside surface.

The portion between the point of inflection and the second end may extend curvilinearly away from the point of inflection inwardly away from the outside surface.

The portion between the first end and the point of inflection may extend linearly away from the first end.

The portion between the point of inflection and the second end may extend linearly away from the point of inflection.

The shoulder may have a shoulder diameter; and wherein a thickness of the shoulder, measured on a horizontal axis from the outside surface to a central axis of the bell, may be at least:

10%;

12%;

14%;

16%;

18%;

20%;

22%; or

24% of the shoulder diameter; and/or at most:

30%;

28%;

26%; or

24% of the shoulder diameter.

The horizontal axis may pass through the point of inflection.

There is also provided a method of designing a bell, the bell including:

a lip having a lip diameter (LD) positioned at a bottom of the bell;

a shoulder having a shoulder diameter (SD); and a crown positioned at a top of the bell having a crown height (CH);

the bell having a total perpendicular height (TPH) measured from the lip to the crown;

wherein the method includes the steps of:

choosing a strike frequency for the bell;

choosing the lip diameter for the bell based on the desired strike frequency; and calculating the total perpendicular height (TPH) of the bell using the following formula:

$$TPH=0.8146*LD-26.124$$

The method may further include the step of varying the total perpendicular height to optimise one or more of the following:- a hum frequency of the bell;

a strike frequency of the bell;

a tierce frequency of the bell;

a quint frequency of the bell;

a nominal frequency of the bell.

The total perpendicular height may be within ±5.00%; ±4.00%; ±3.00%; ±2.00%; or ±1.00% of the total perpendicular height calculated using the formula.

The method may further include the step of determining the crown height using the following formula:

$$CH=0.0807*TPH-0.0026$$

The method may further include the step of varying the crown height to optimise one or more of the following:- a hum frequency of the bell;

a strike frequency of the bell;

a tierce frequency of the bell;

a quint frequency of the bell;

a nominal frequency of the bell.

The crown height may be within ±32.00%; ±29.00%; ±28.00%; ±20.00%; ±10.00%; ±5.00%; ±4.00%; or ±3.95% of the crown height determined using the formula.

The bell may have a mouth diameter which is substantially the same as the lip diameter.

The lip diameter may be at least:

135 mm;

155 mm;

175 mm;

195 mm;

215 mm;

235 mm;

255 mm;

275 mm;

295 mm;

315 mm;

335 mm 355 mm;

375 mm;

395 mm;

415 mm; or 435 mm.

The lip diameter may be at most:

420 mm;

400 mm; or 380 mm.

The method may further include the step of varying the shoulder diameter to optimise one or more of the following:- a hum frequency of the bell;

a strike frequency of the bell;

a tierce frequency of the bell;

a quint frequency of the bell;

a nominal frequency of the bell.

There is also provided a method of designing a bell, the bell including:

a lip having a lip diameter (LD) positioned at a bottom of the bell;

a shoulder having a shoulder diameter (SD); and a crown positioned at a top of the bell having a crown height (CH);

the bell having a total perpendicular height (TPH) measured from the lip to the crown;

wherein the method includes the steps of:- choosing a strike frequency for the bell;

choosing the lip diameter for the bell based on the desired strike frequency wherein the lip diameter is at least 250 mm; and calculating the shoulder diameter using the following formula:

$$SD=0.5490*LD-0.0024$$

The shoulder diameter may be within ±5.00%; ±4.75%; ±3.00%; ±2.00%; ±1.15%; ±1.00%; ±0.50%; ±0.20%; or ±0.05% of the shoulder diameter determined using the formula.

This method may include one or more or all of the features of the other methods and bells.

There is also provided a bell including:

a lip having a lip diameter (LD) positioned at a bottom of the bell;

a shoulder having a shoulder diameter (SD); and a crown positioned at a top of the bell having a crown height (CH);

the bell having a total perpendicular height (TPH) measured from the lip to the crown;

wherein the lip diameter (LD) is at least 250 mm; and the shoulder diameter (SD) is equal to:

$$SD=(0.5490*LD-0.0024)\pm1.00\%$$

This bell may include one or more or all of the features of the other methods and bells.

There is also provided a method of designing a bell, the bell including:

a lip having a lip diameter (LD) positioned at a bottom of the bell;

a shoulder having a shoulder diameter (SD); and a crown positioned at a top of the bell having a crown height (CH);

the bell having a total perpendicular height (TPH) measured from the lip to the crown;

wherein the method includes the steps of:- choosing a strike frequency for the bell;

choosing the lip diameter for the bell based on the desired strike frequency; and calculating the shoulder diameter (SD) of the bell using the following formula:

$$SD=0.5764*LD$$

The shoulder diameter may be within ±5.00%; ±4.75%; ±3.00%; ±2.00%; ±1.15%; ±1.00%; ±0.50%; ±0.20%; or ±0.05% of the shoulder diameter determined using the formula.

The lip diameter may be at most 250 mm.

A waist of the bell may be positioned between the shoulder and the lip and a thickness of the waist, measured in a direction from an outside surface of the bell to a central axis of the bell, may be less than a thickness of the shoulder.

This method may include one or more or all of the features of the other methods and bells.

There is also provided a bell including:

a lip having a lip diameter (LD) positioned at a bottom of the bell;

a shoulder having a shoulder diameter (SD);

a crown positioned at a top of the bell having a crown height (CH); and a total perpendicular height (TPH) measured from the lip to the crown;

wherein the shoulder diameter (SD) is equal to:

$$SD=(0.5764*LD)\pm5.00\%$$

This bell may include one or more or all of the features of any of the other methods and bells.

There is also provided a bell including:

an outside surface which defines an exterior of the bell;

an inside surface which defines an interior of the bell;

a lip positioned at a bottom of the bell;

a sound bow positioned above the lip;

a waist positioned above the sound bow;

a shoulder positioned above the waist; and a crown positioned at a top of the bell above the shoulder;

wherein a portion of the inside surface generally adjacent the shoulder has a first end at or near the crown; a second end at or near the waist and a point of inflection or a midpoint generally in-between the first and second ends;

wherein as the portion of the inside surface extends away from the first end towards the point of inflection or midpoint the portion extends away from the crown more than it extends towards the outside surface; and as the portion of the inside surface extends towards the second end from the point of inflection or midpoint the portion extends towards the outside surface more than it extends away from the crown.

The point of inflection or midpoint may be positioned substantially halfway between the first and second ends.

The portion between the first end and the point of inflection or midpoint may extend curvilinearly away from the first end inwardly away from the outside surface.

The portion between the point of inflection or midpoint and the second end may extend curvilinearly away from the point of inflection or midpoint inwardly away from the outside surface.

The portion between the first end and the point of inflection or midpoint may extend linearly away from the first end.

The portion between the point of inflection or midpoint and the second end may extend linearly away from the point of inflection or midpoint.

The shoulder may have a shoulder diameter; and a thickness of the shoulder, measured on a horizontal axis from the outside surface to a central axis of the bell, may be at least:

10%;

12%;

14%;

16%;

18%;

20%;

22%; or

24% of the shoulder diameter; and/or at most:

30%;

28%;

26%; or

24% of the shoulder diameter.

This bell may include one or more or all of the features of any of the other methods and bells.

There is also provided a plurality of bells including a bell made in accordance with any one of the bells described.

There is also provided a carillon including one or more bells in accordance with any one of the bells described.

There is also provided a carillon including a plurality of bells in accordance with the bells described.

There is also provided a mould for a bell in accordance with the bells described.

There is also provided a CAD file for a bell in accordance with the bells described.

BRIEF DESCRIPTION OF THE FIGURES

These and other features of the disclosure will now be described, by way of example only, with reference to the accompanying figures of which.

DESCRIPTION OF EMBODIMENTS

Figure 1:
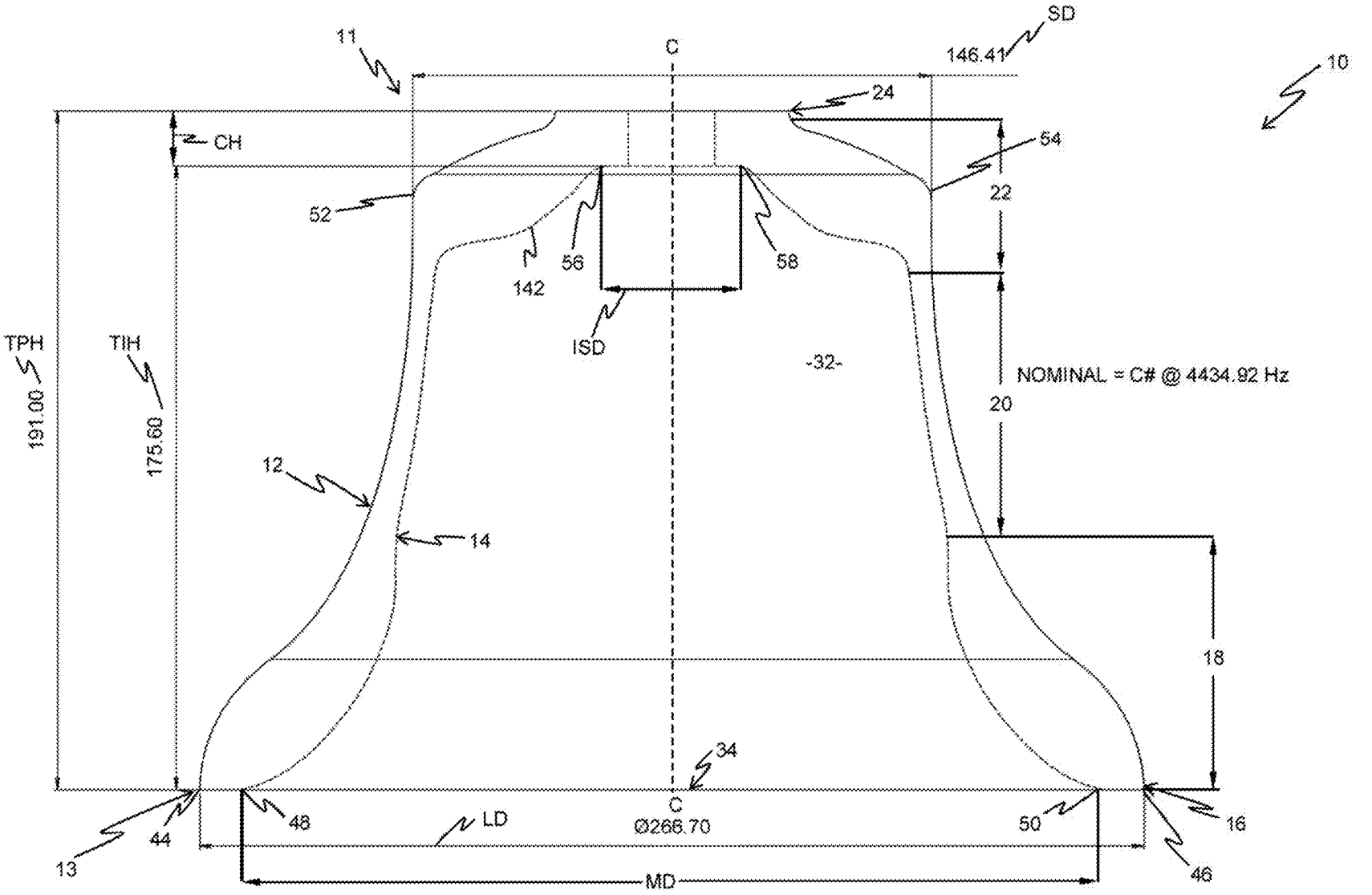
FIGS. 1 to 12 show profile cross-sectional views of a first set of bells in accordance with embodiments of the present disclosure.
Figure 2:
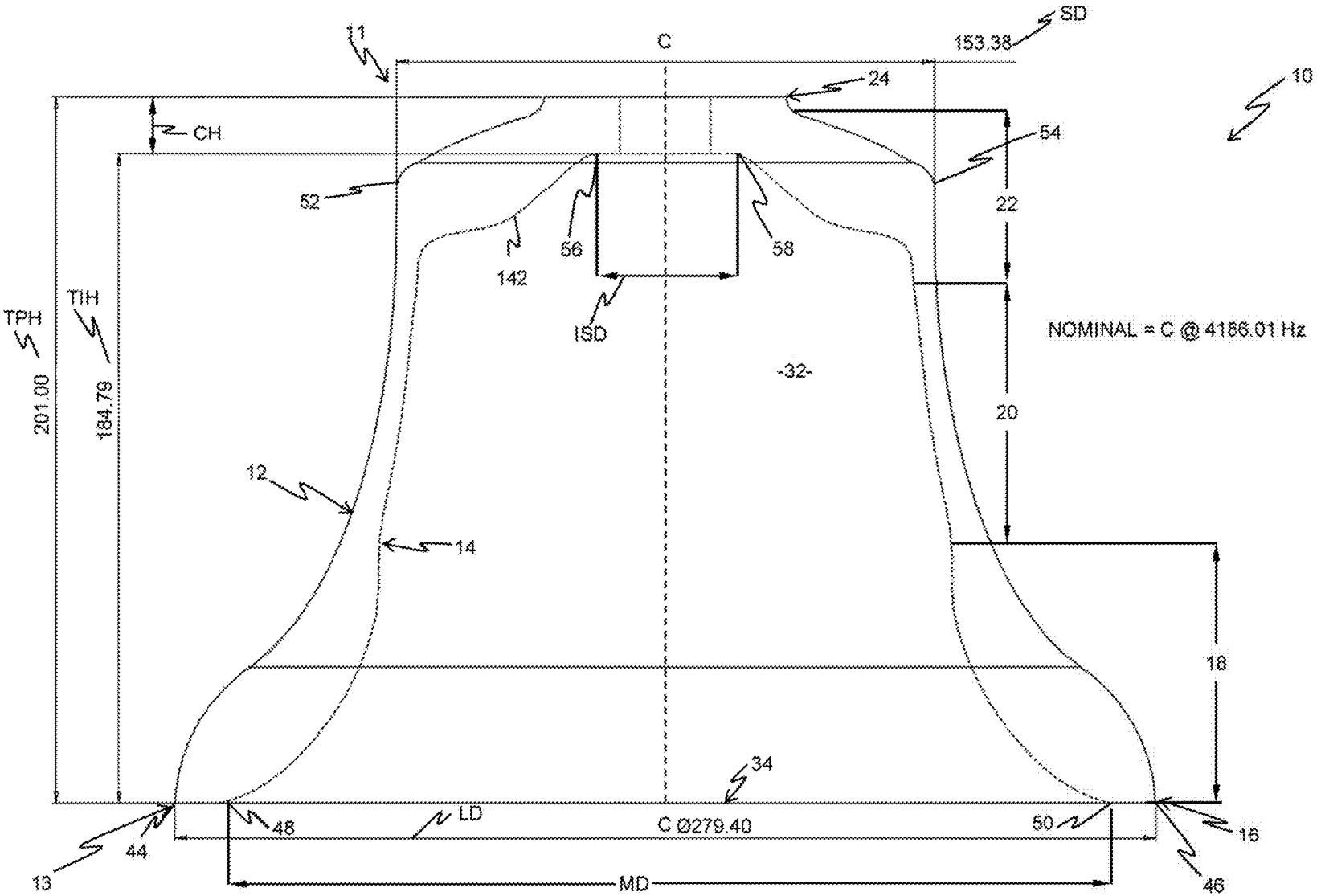
Figure 3:
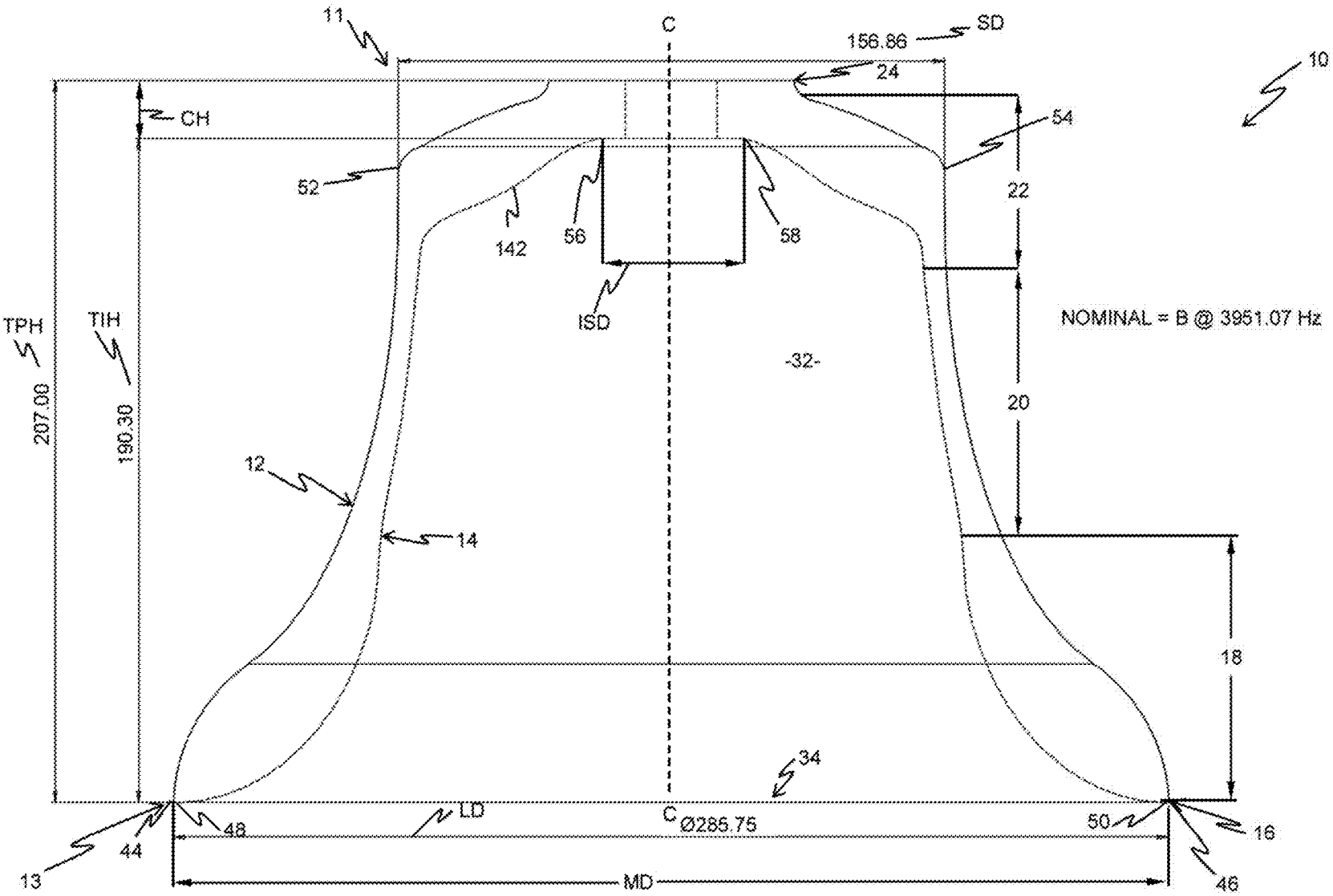
Figure 4:
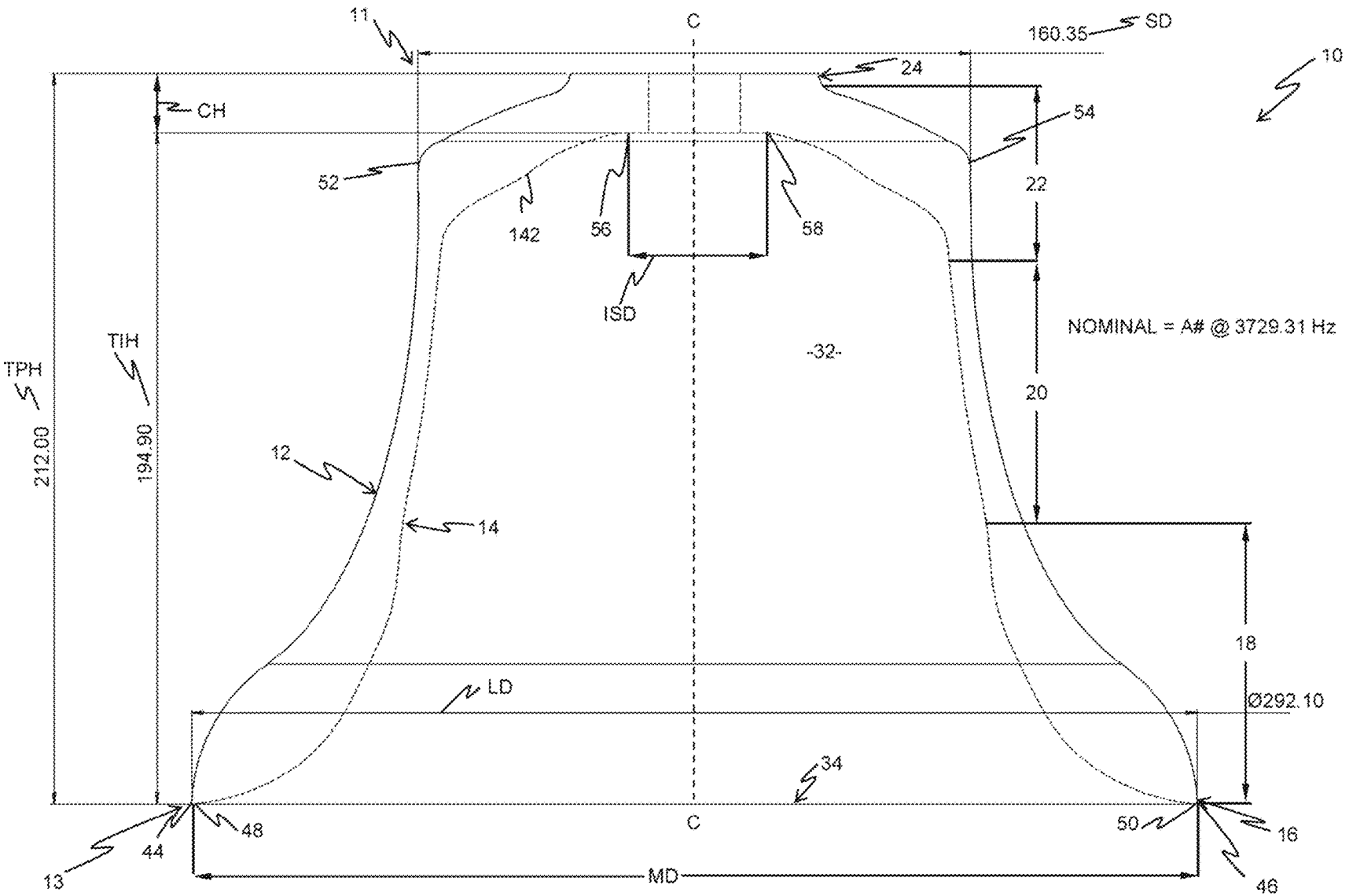
Figure 5:
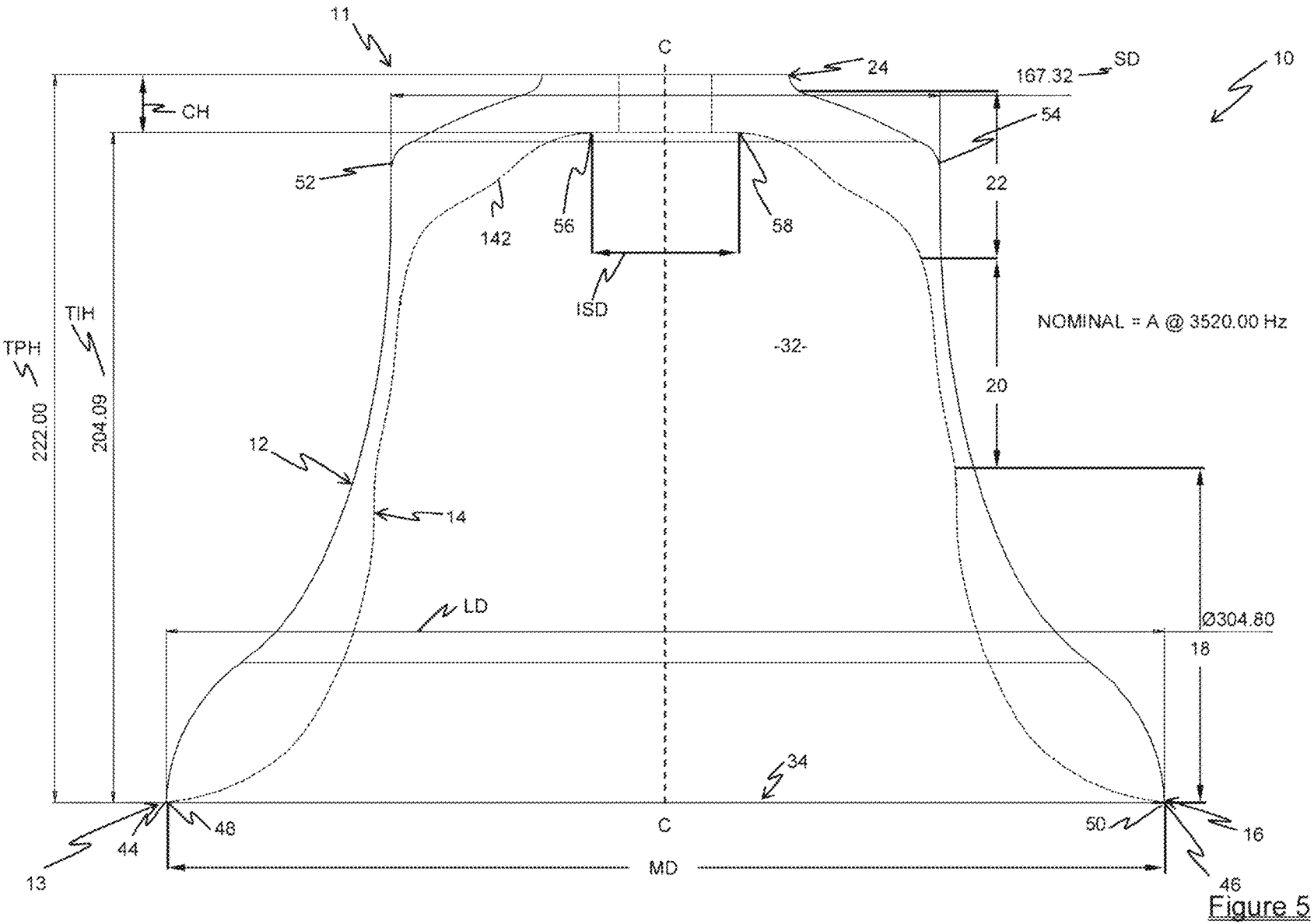
Figure 6:
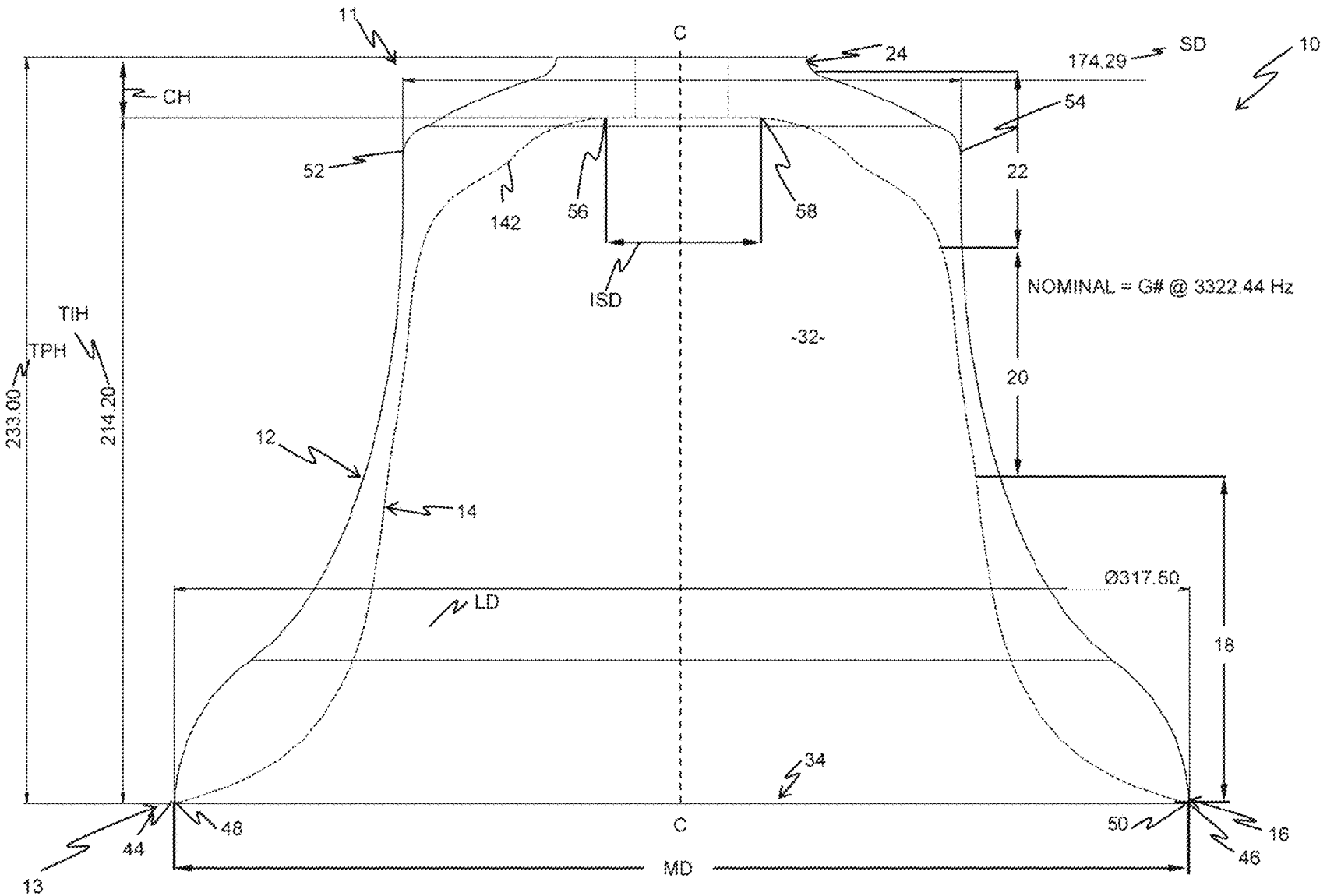
Figure 7:
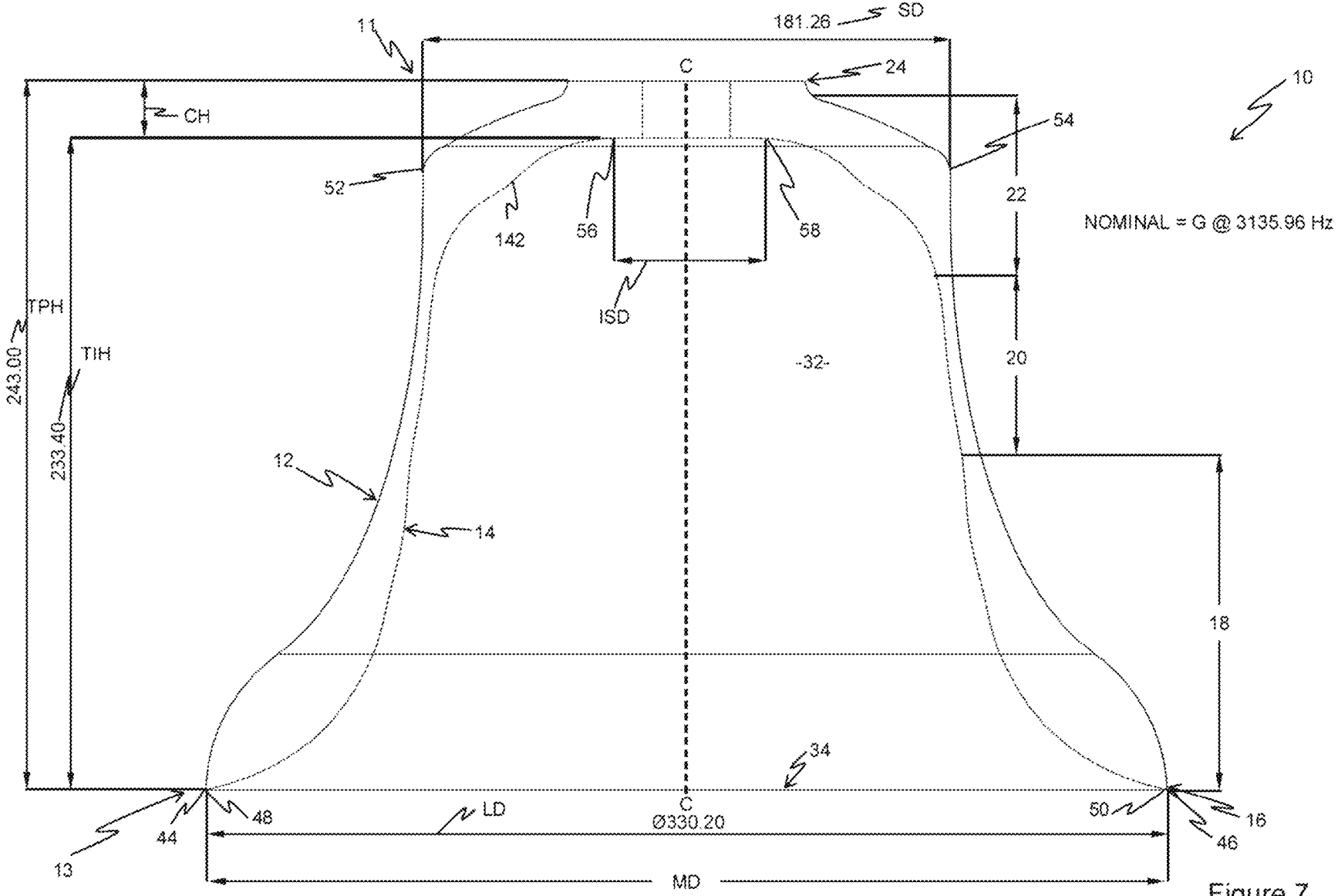
Figure 8:
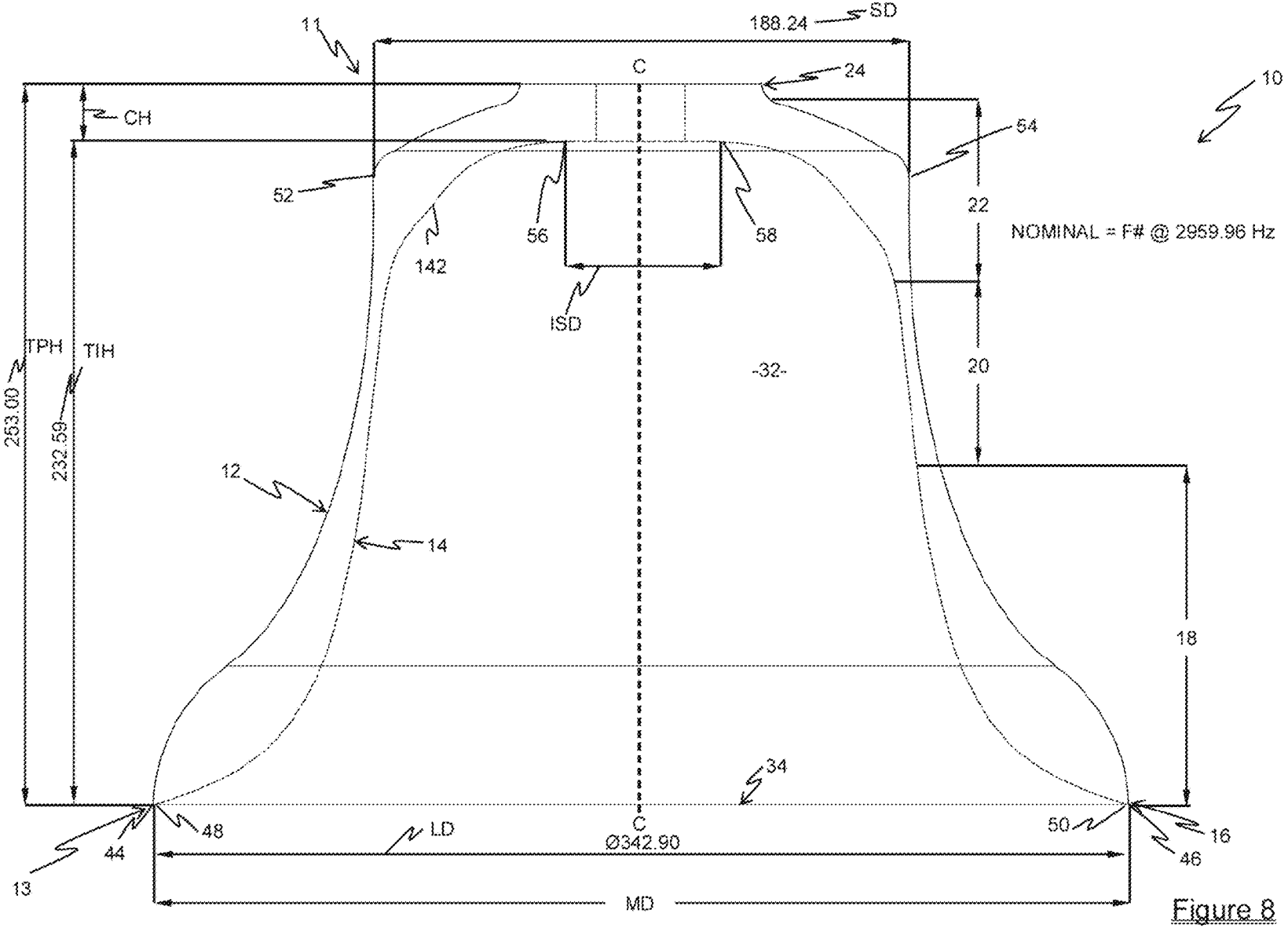
Figure 9:
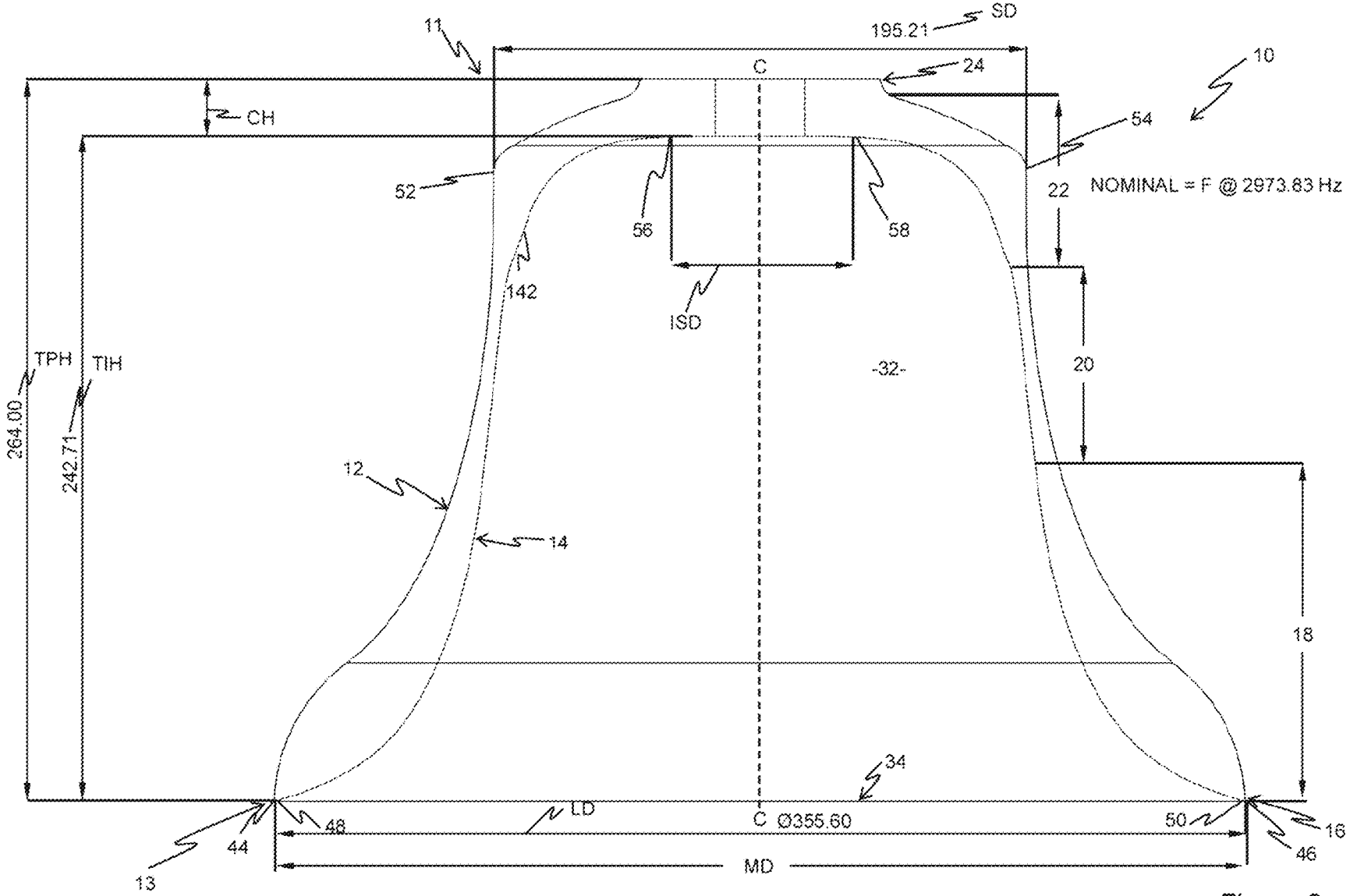
Figure 10:
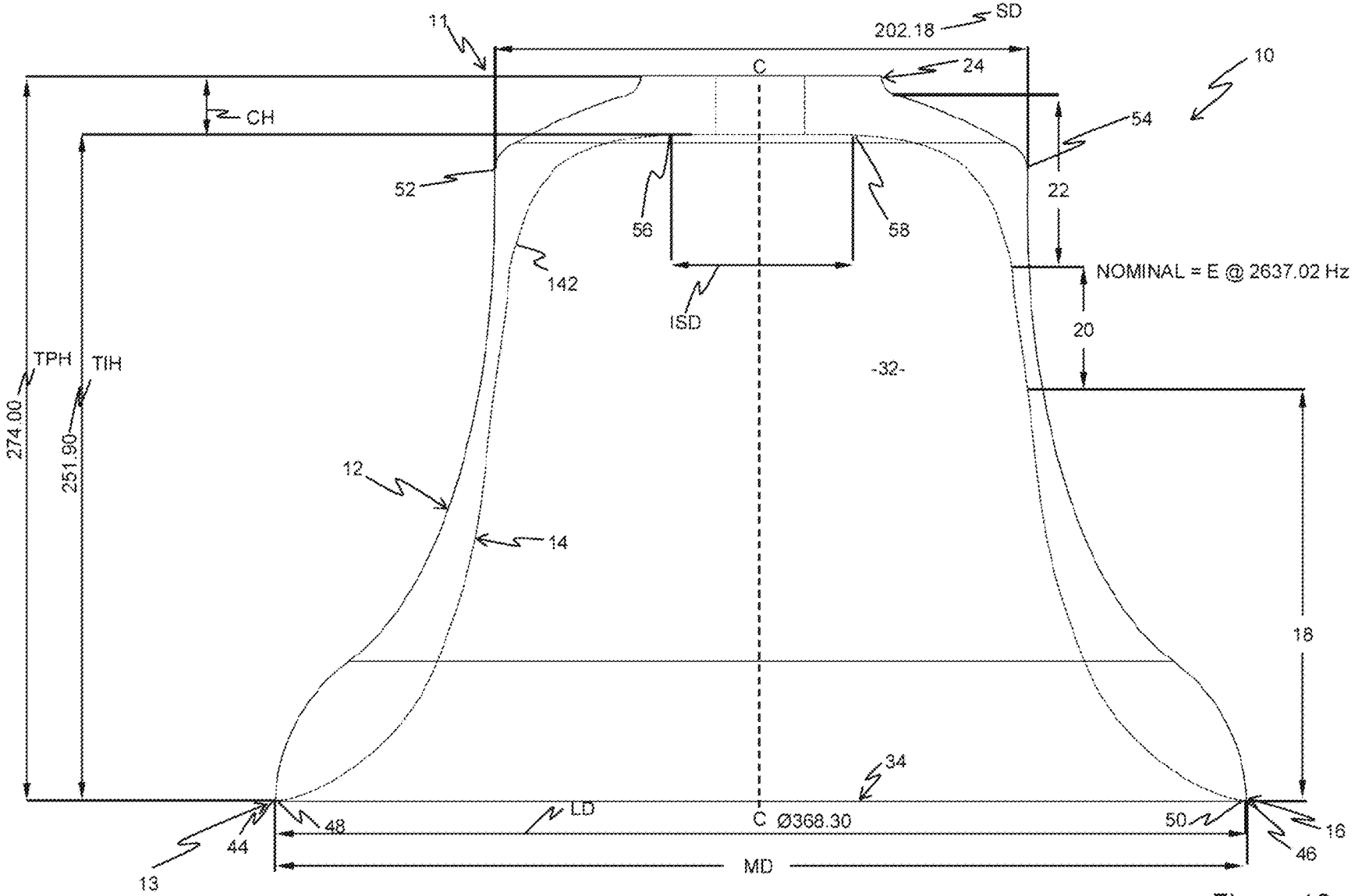
Figure 11:
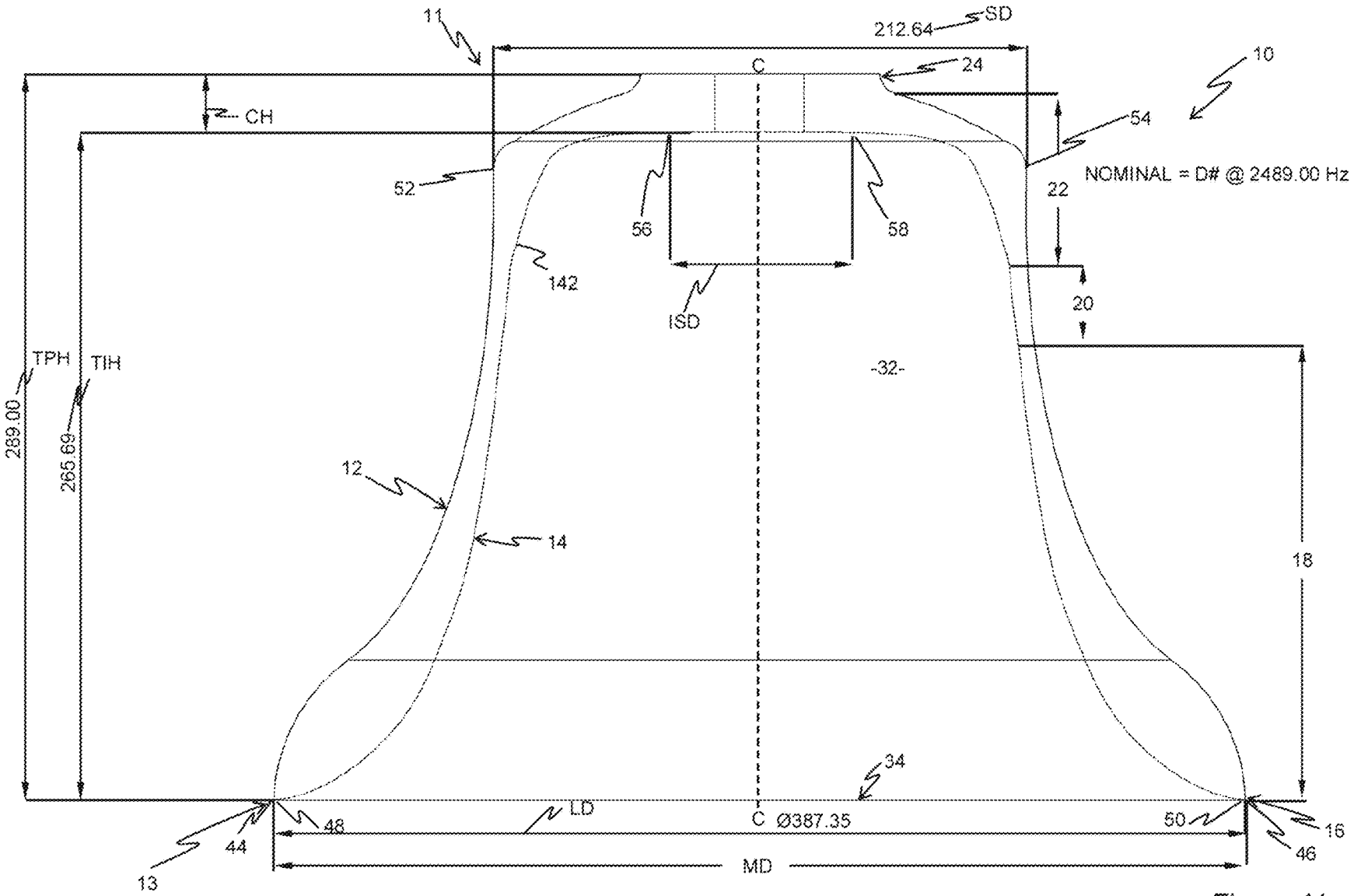
Figure 12:
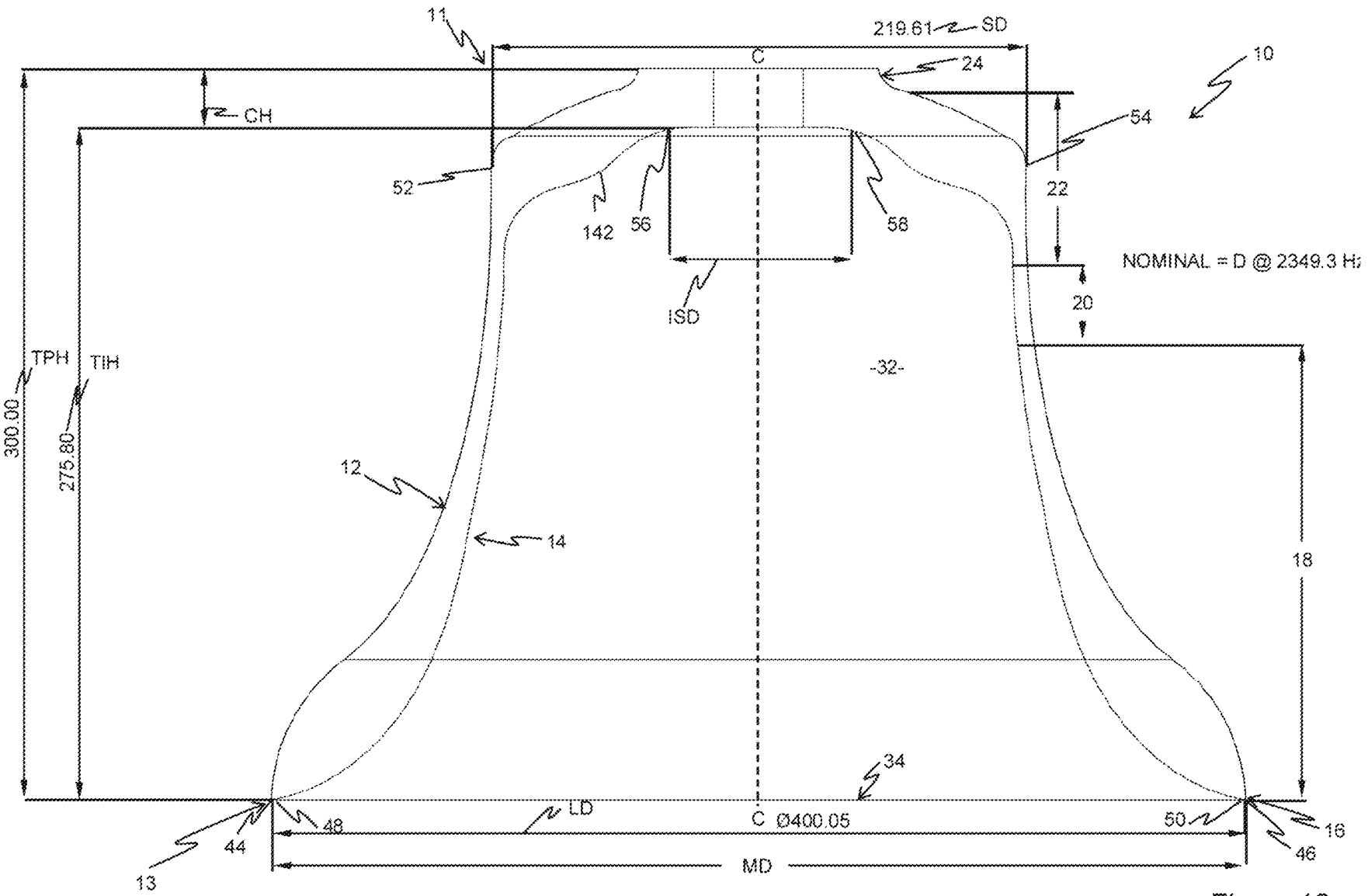

Referring to the figures there is shown a cross-section profile of a first embodiment of a bell 10 in accordance with the present disclosure. For the sake of simplicity embodiments of the disclosure are described with reference to FIG. 1, though it should be appreciated that the description regarding FIG. 1 applies to FIGS. 2 to 36 unless expressly stated otherwise.

The bell 10 has an outside surface 12 which defines the overall shape of the bell 10 and an inside surface 14. The inside surface 14 defines a recess 32 in which air resonates to transmit the sound characteristic of the bell 10.

The bell 10 is split into various parts. At a bottom of the bell 10 is positioned a lip 16. The lip 16 connects the outside and inside surfaces 12, 14. A mouth 34 of the bell 10 is defined by the lip 16. The bell 10 also includes a sound bow 18, a waist 20, a shoulder 22 and a crown 24.

The sound bow 18 is positioned above the lip 16 and is defined between the outer and inner surfaces 12, 14. The waist 20 is positioned above the sound bow 18 and is defined between the outer and inner surfaces 12, 14. The shoulder 22 of the bell 10 is positioned above the waist 20 and is defined between the outer and inner surfaces 12, 14. The crown 24 is positioned above the shoulder 22 and defines the top of the bell 10.

The outer surface 12 of the bell 10 extends generally upwardly and inwardly from the lip 16 across the sound bow 18 to the waist 20. In particular the outer surface 12 may extend convexly with respect to a central axis C of the bell 10 from the lip 16 across the sound bow 18 to the waist 20 in a direction away from the inner surface 14. The inside surface 14 extends generally upwardly and inwardly from the lip 16 across the sound bow 18 to the waist 20 also. In particular, the inner surface 14 may extend convexly with respect to the central axis C from the lip 16 across the sound bow 18 to the waist 20 in a direction away from the outer surface 12.

The outer surface 12 of the bell 10 extends generally upwardly and inwardly from the sound bow 18 across the waist 20 to the shoulder 22. In particular, the outer surface 12 may extend concavely from the sound bow 18 across the waist 20 to the shoulder 22 towards the central axis C of the bell 10. The inside surface 14 extends generally upwardly and inwardly from the sound bow 18 across the waist 20 to the shoulder 22 also. In particular, the inner surface 14 may extend concavely from the sound bow 18 across the waist 20 to the shoulder 22 with respect to the central axis C.

The outer surface 12 of the bell 10 extends generally upwardly and inwardly from the waist 20 across the shoulder 22 to the crown 24. In particular, the outer surface 12 may extend concavely from the waist 20 across the shoulder 22 to the crown 24 with respect to the central axis C. The inside surface 14 extends generally upwardly and inwardly from the waist 20 across the shoulder 22 to the crown 24 also. In particular, the inner surface 14 may extend concavely from the waist 20 across the shoulder 22 to the crown 24 with respect to the central axis C.

The crown 24, in use, may be attached to a canon (not shown), which may be, in turn, connected to a yoke (not shown) to enable the bell 10 to be swung and rung effectively. Alternatively, the crown may be attached to a frame in a fixed position. The outer surface 12 of the bell 10 extends generally inwardly from the shoulder 22 to the crown 24 to define a top 11 of the bell 10. The inside surface 14 of the bell 10 also extends generally inwardly from the shoulder 22 to the crown 24.

The lip 16 defines a lip diameter (LD), also referred to as the greatest diameter. The lip diameter is measured from a first point 44 on the lip 16 on the outer surface 12 to a second point 46 on the lip 16 on the outer surface 12 directly opposite the first point 44.

The mouth 34 may have a mouth diameter (MD). The mouth diameter (MD) may be measured from a first point 48 on the lip 16 on the inner surface 14 to a second point 50 on the lip 16 on the inner surface 14 directly opposite the first point 48. The lip diameter may be the same as a mouth diameter of the bell 10. Alternatively the lip diameter and the mouth diameter may differ.

The shoulder 22 may have an external shoulder diameter (SD). The external shoulder diameter may be measured from a first point 52 on the outer surface 12 of the shoulder 22 to a second point 54 on the outer surface 12 of the shoulder 22 directly opposite the first point 52.

The shoulder 22 may also have an internal shoulder diameter (ISD). The internal shoulder diameter may be measured from a first point 56 on the inner surface 14 of the shoulder 22 to a second point 58 on the inner surface 14 of the shoulder 22 directly opposite the first point 56.

The bell 10 may have a total perpendicular height (TPH). The total perpendicular height may be measured by measuring the vertical distance between the top 11 of the bell 10 and a bottom 13 of the bell 10.

The bell may have a total inner height (TIH). The total inner height (TIH) may be measured by measuring the vertical difference between the inner surface 14 at the crown 24 and the bottom 13 of the bell 10.

The bell may have a crown height (CH). The crown height (CH) may be the difference between the total perpendicular height (TPH) and the total inner height (TIH).

The bell 10 is capable of producing various frequencies when it is struck. The bell 10 is tuned to a nominal, or strike, frequency which is the dominant frequency perceived by the human ear. The strike frequency is produced predominantly by the lip 16 and sound bow 18 of the bell 10, with some minor involvement from the waist 20.

The bell 10 produces a hum frequency which is two octaves below the strike frequency. The hum frequency is produced by the entire bell 10, but is most dominant in the lip 16 and sound bow 18.

The bell 10 produces a fundamental, or prime, frequency which is an octave above the hum frequency and an octave below the strike frequency. The fundamental frequency is produced predominantly by the waist 12 and the lip 16 oscillating about the top of the sound bow 18.

The bell 10 produces a tierce frequency, which is a minor third above the fundamental frequency. The tierce frequency is produced predominantly by the lip 16 but there is also some minor involvement of the sound bow 18.

The bell 10 produces a quint frequency which is a fifth above the fundamental frequency. The quint frequency is produced predominantly by the waist 20 of the bell 10 but there is also involvement of the lip 16.

Figure 37:
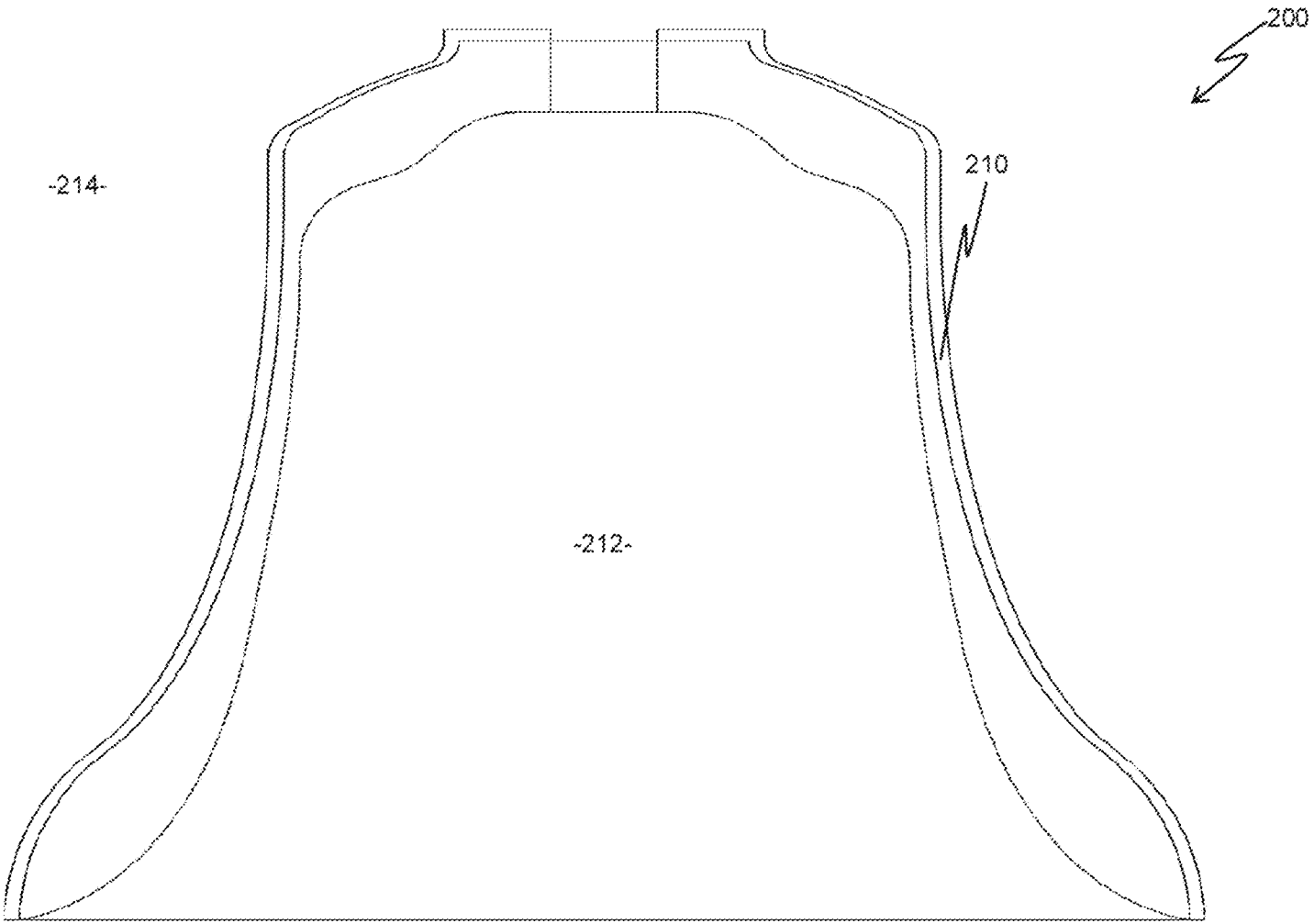
FIG. 37 shows a profile cross-sectional view of a mould for casting a bell as shown in FIGS. 1 to 36.

Bells are typically cast using a mould 200 in a sand bed, as shown in FIG. 37. The mould 200 is typically formed of two parts, an outer part 210 and an inner part 212, made of cast iron. The inner and outer parts 210, 212 may be housed in cast iron cases 214. The mould 200 defines an outer surface of the bell 10 and an inner surface of the bell 10. Molten metal is poured into the mould 200 and is then allowed to set. The metal used is typically an alloy of copper and tin in a ratio of approximately 4:1 (commonly referred to as bell metal). The present disclosure includes a mould for a bell in accordance with the present disclosure and/or a mould for a bell designed in accordance with a method of the present disclosure.

Once the bell 10 has been cast it is tuned to try and optimise the frequencies produced by the bell 10. This is done by removing small amounts of the bell metal from the inner surface 14. Small amounts of the bell metal from the outer surface 12 may also be removed as part of the tuning process.

The applicant has found that there are various ways in which the frequencies produced by a bell 10 can be altered. The applicant has also found that there are ways to make particular frequencies produced by the bell 10 have a greater amplitude than was previously possible. The applicant has also found that it is possible to vary the time at which a frequency has the greatest amplitude. Further the applicant has found that it is possible to vary the rate at which the amplitude of these frequencies decays—known as the growth and decay profiles. This is advantageous because the overall frequency and amplitude characteristics of the bell 10 can be tailored to produce a more pleasing bell frequency characteristic, or to make smaller bells sound louder whilst maintaining their sound profile.

A method of designing a bell in accordance with the disclosure will now be described. The method includes the steps of choosing a strike frequency for the bell; choosing the lip diameter for the bell based on the desired strike frequency (in millimetres); and calculating the total perpendicular height (TPH) of the bell (in millimetres) using the following formula:

$$TPH=0.8146*LD-26.124$$

This is advantageous because the use of this formula to calculate the total perpendicular height has been found to produce a bell 10 having more pleasing frequency characteristics than was previously possible. In particular, it has been found that the amplitude of the frequencies produced by a bell having a total perpendicular height calculated by the above formula seems to increase or "grow" before decreasing or "decaying". This produces a more pleasing sound profile to the bell 10 than was previously possible.

The method may further include the step of varying the total perpendicular height of the bell 10. In particular, the total perpendicular height may be varied within ±5.00%; ±4.00%; ±3.00%; ±2.00%; or ±1.00% of the total perpendicular height calculated using the formula. This is advantageous because it enables a user to optimise one or more of the frequencies produced by the bell 10, such as the hum, fundamental, tierce, quint or nominal frequencies.

By optimise we mean that the frequencies may be more accurately matched to an ideal model and/or the growth and decay profile of the specific frequencies produced by the bell 10 to produce a desired sound profile for the bell 10.

The method may further include the step of determining the crown height using the following formula:

$$CH=0.0807*TPH-0.0026$$

This may be advantageous in helping to produce a more pleasing sound profile for the strike frequency and quint frequency as the thickness of the crown 24 alters how the waist 20 oscillates when the bell 10 is struck.

The method may further include the step of varying the crown height of the bell 10. In particular, the crown height may be varied within ±32.00%; ±29.00%; ±28.00%; ±20.00%; ±10.00%; ±5.00%; ±4.00%; or ±3.95% of the crown height determined using the formula. This is advantageous because it enables a user to optimise one or more of the frequencies produced by the bell such as the hum, strike, tierce, quint and nominal frequencies.

The bell 10 may have a mouth diameter (MD) which is substantially the same as the lip diameter (LD). This has been found to produce a bell having a more pleasing hum frequency sound profile which enables the other frequencies of the bell to be better heard.

The lip diameter may be at least 135 mm; 150 mm; 155 mm; 160 mm; 170 mm; 175 mm; 180 mm; 190 mm; 195 mm; 200 mm; 210 mm; 215 mm; 220 mm; 230 mm; 235 mm; 240 mm; 250 mm; 255 mm; 275 mm; 295 mm; 315 mm; 335 mm; 355 mm; 375 mm; 395 mm; 415 mm; or 435 mm. The lip diameter may be at most: 420 mm; 400 mm; 380 mm; 250 mm; 245 mm; or 240 mm.

The method may further include the step of varying the shoulder diameter. This is advantageous because it enables a user to further optimise one or more of the hum, fundamental, tierce, quint and nominal frequencies of the bell 10.

A further method of designing a bell in accordance with the disclosure will now be described. This method may be used in conjunction with the method described above. The method includes the steps of choosing a strike frequency for the bell; choosing the lip diameter for the bell based on the desired strike frequency wherein the lip diameter is at least 250 mm; and calculating the shoulder diameter using the following formula:

$$SD=0.5490*LD-0.0024$$

The method may further include the step of varying the shoulder diameter of the bell 10. In particular, the shoulder diameter may be varied within ±5.00%; ±4.75%; ±3.00%; ±2.00%; ±1.15%; ±1.00%; ±0.50%; ±0.20%; or ±0.05% of the shoulder diameter determined using the formula.

In particular, the bell 10 may have a shoulder diameter (SD) equal to:

$$SD=(0.5490*LD-0.0024)\pm1.00\%$$

The bell may also have a lip diameter (LD) of at least 250 mm.

It has been found that by designing a bell using the above formula to calculate the ideal shoulder diameter a better tuning of the frequencies of the bell can be achieved.

Another method of designing a bell in accordance with the disclosure will now be described. This method may be used in conjunction with the first method described above. The method includes the steps of choosing a strike frequency for the bell; choosing the lip diameter for the bell based on the desired strike frequency; and calculating the shoulder diameter (SD) of the bell using the following formula:

$$SD=0.5764*LD$$

In particular, the lip diameter may be selected to be at most 250 mm.

The method may further include the step of varying the shoulder diameter of the bell 10. In particular, the shoulder diameter may be varied within ±5.00%; ±4.75%; ±3.00%; ±2.00%; ±1.15%; ±1.00%; ±0.50%; ±0.20%; or ±0.05% of the shoulder diameter determined using the formula.

The method may include the step of selecting a thickness of the waist, measured from an outside surface 12 of the bell 10 to an inside surface 14 of the bell 10 in a direction generally perpendicular to the central axis C of the bell, to be less than a thickness of the shoulder measured in the same way.

The bell 10 may have a shoulder diameter (SD) equal to:

$$SD=(0.5764*LD)\pm5.00\%$$

By providing a shoulder diameter on a bell using the above formula the frequencies produced by the bell may be better tuned. This is, in particular, because more metal can be introduced into the top of the bell which improves the oscillation modes of the bell, and in particular the shoulder and waist of the bell. Providing a shoulder diameter on a bell using the above formula may also improve the ability to successfully tune the hum, fundamental, tierce, quint and nominal frequencies of the bell 10. The introduction of more metal to the top of the bell also improves the amplitude characteristics of the individual frequencies within the bell and enables a user to control when the particular frequencies will "grow" and "decay" when the bell is struck.

Figure 13:
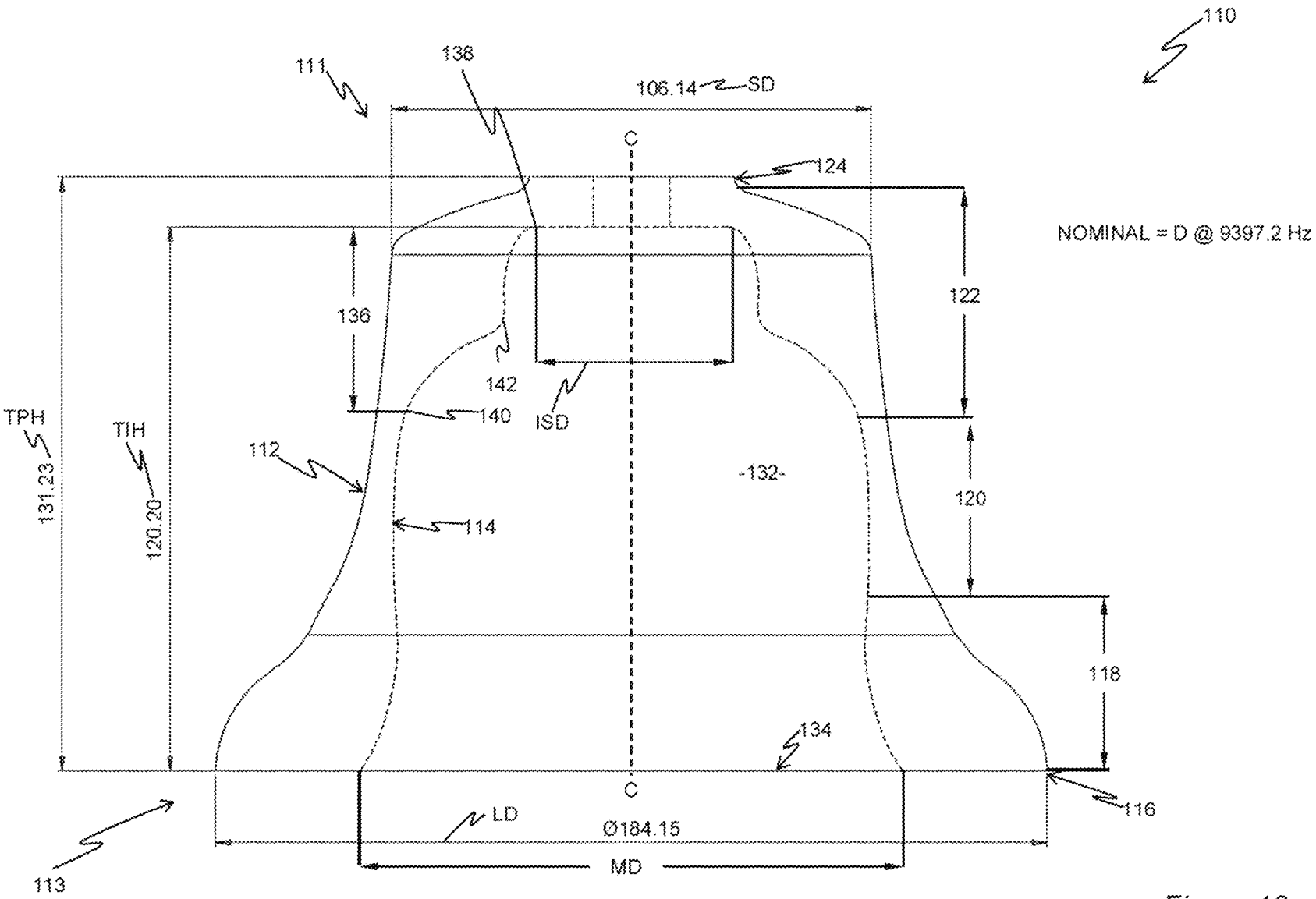
FIGS. 13 to 36 show profile cross-sectional views of a second set of bells in accordance with embodiments of the present disclosure.
Figure 14:
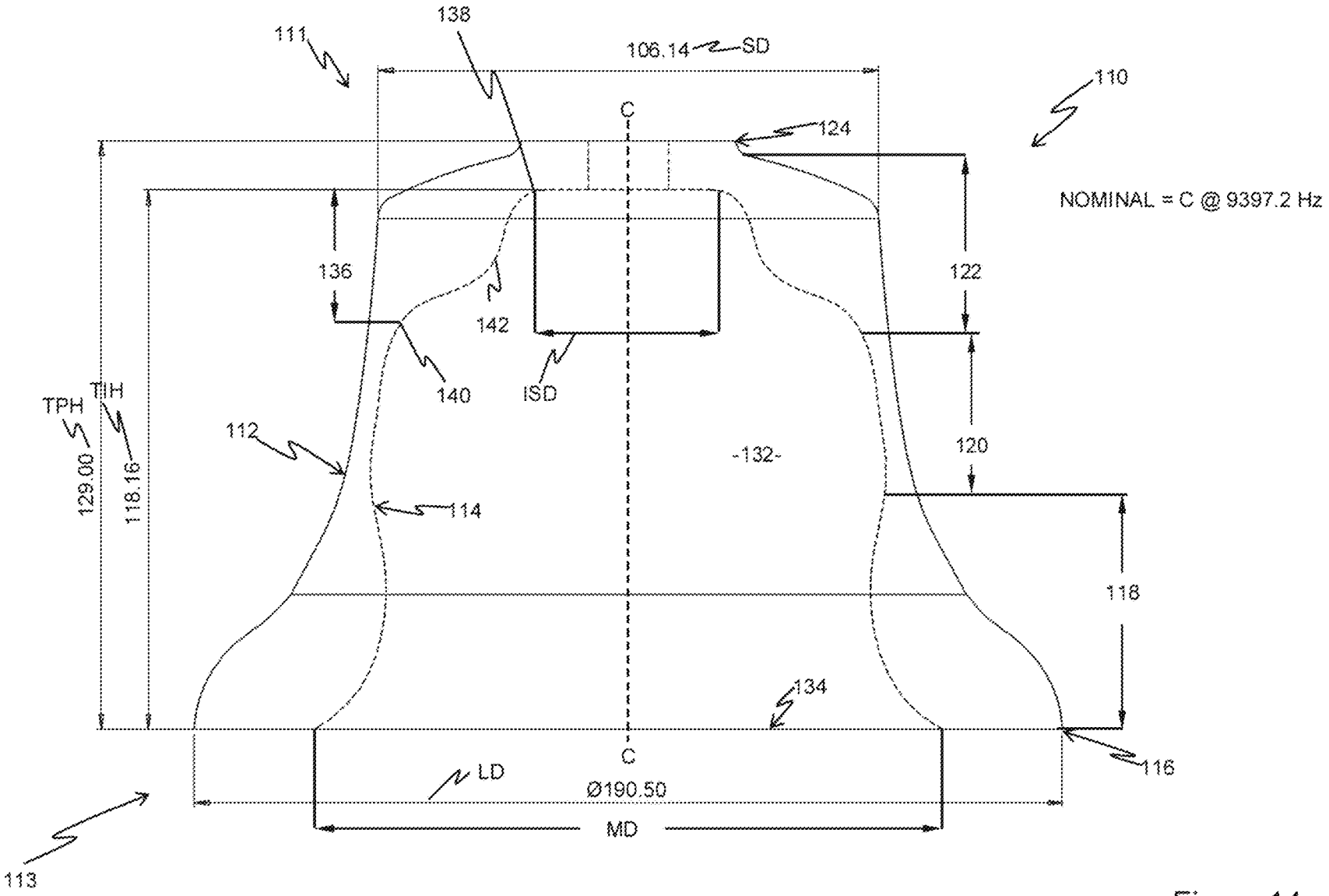
Figure 15:
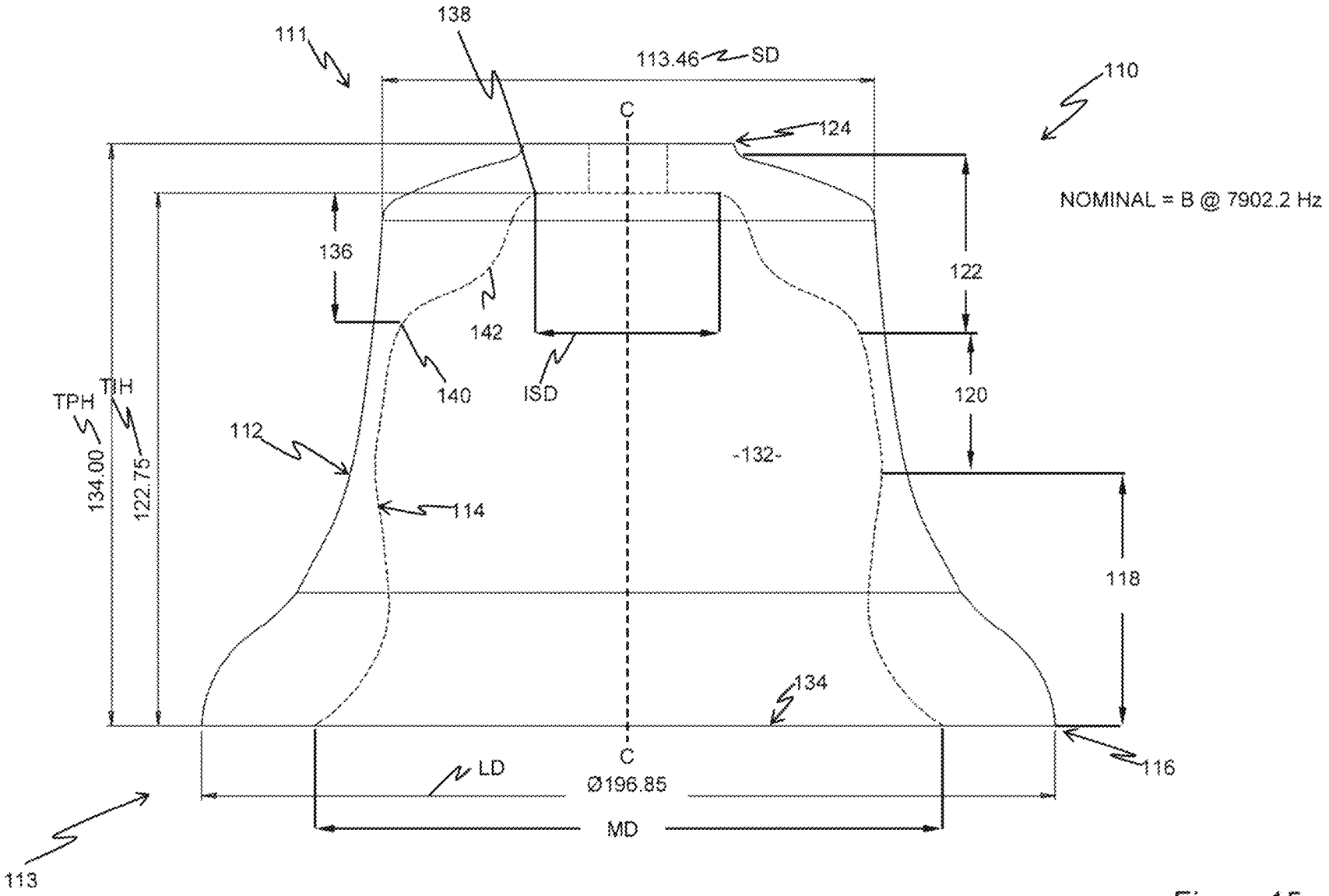
Figure 16:
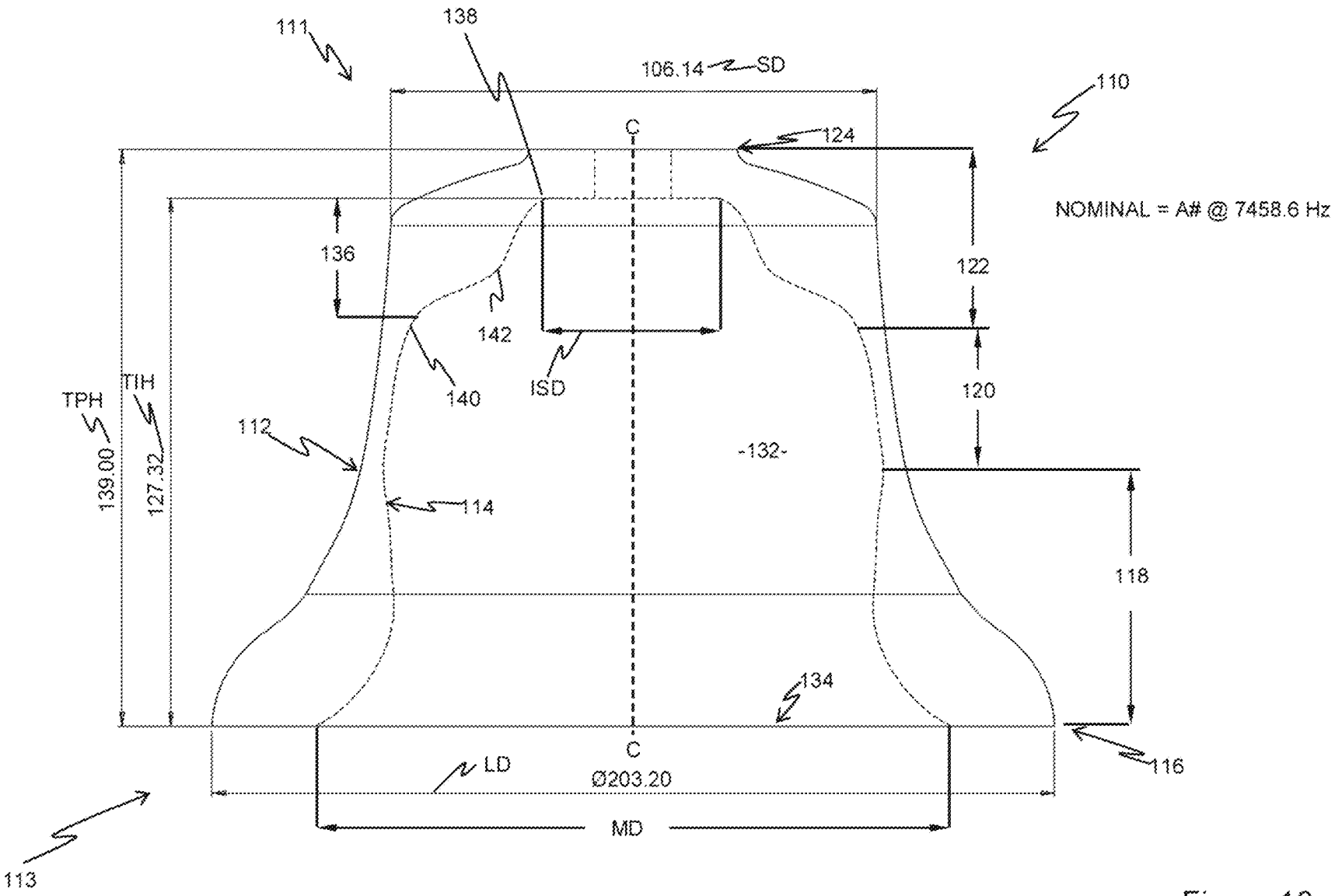
Figure 17:
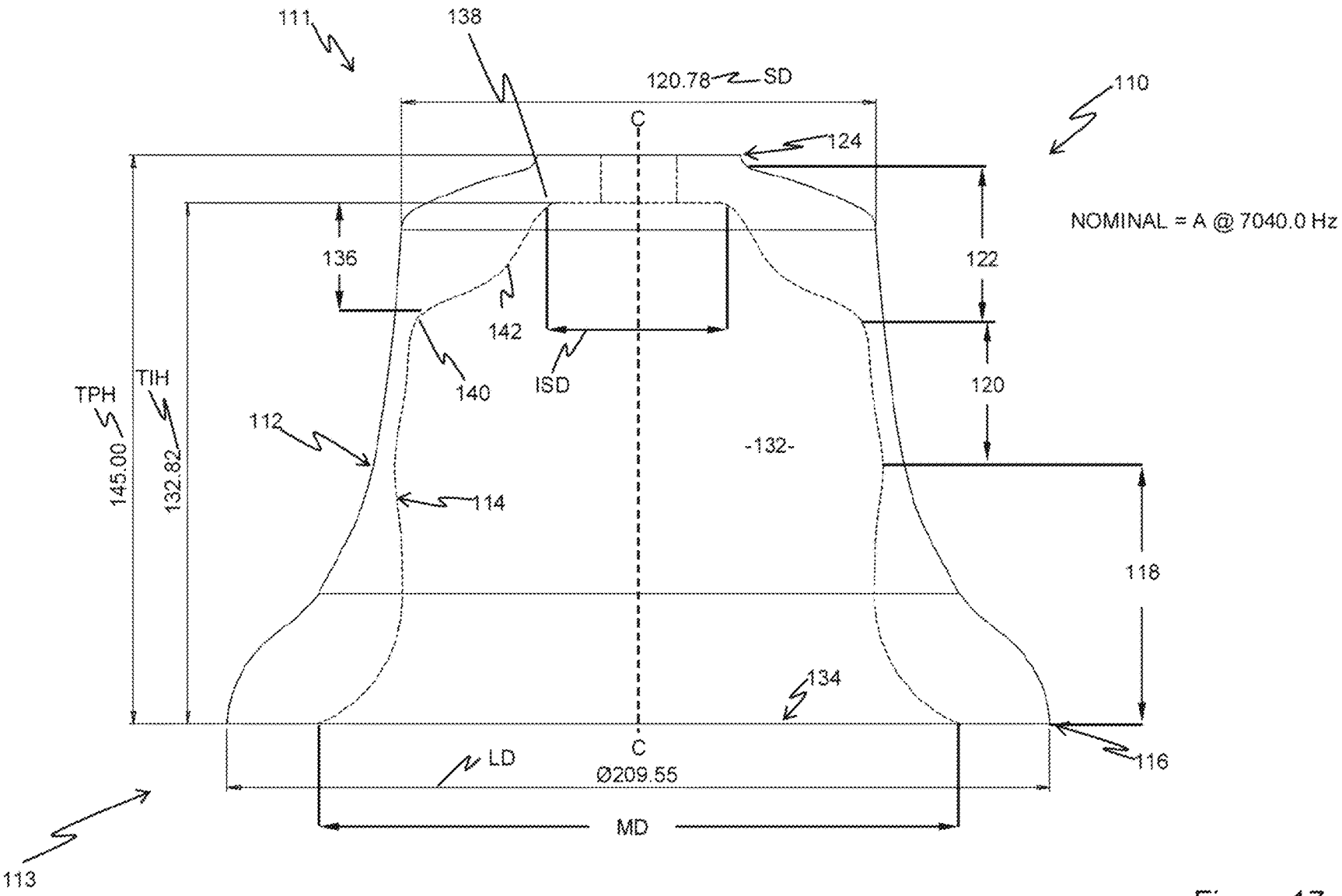
Figure 18:
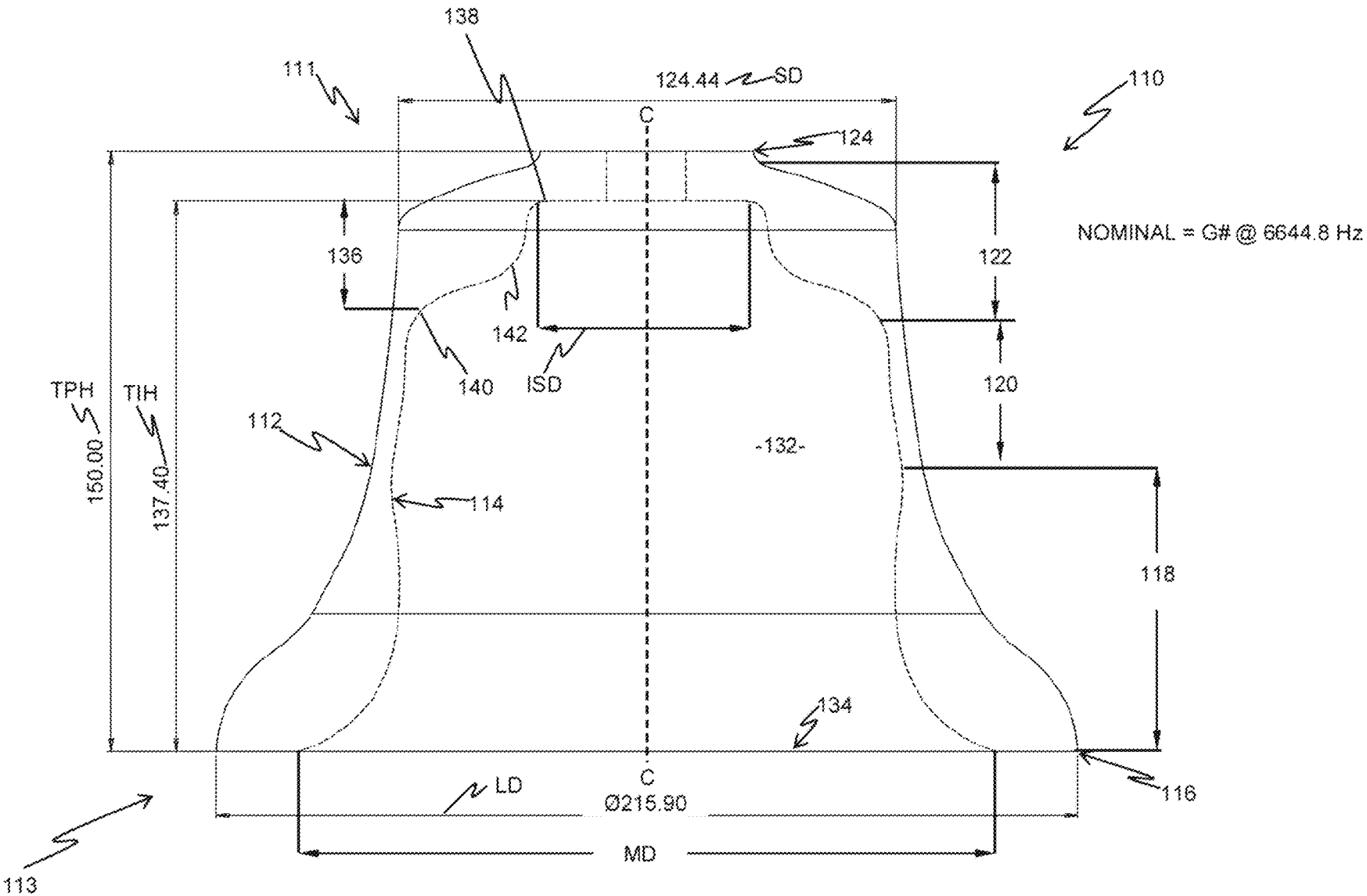
Figure 19:
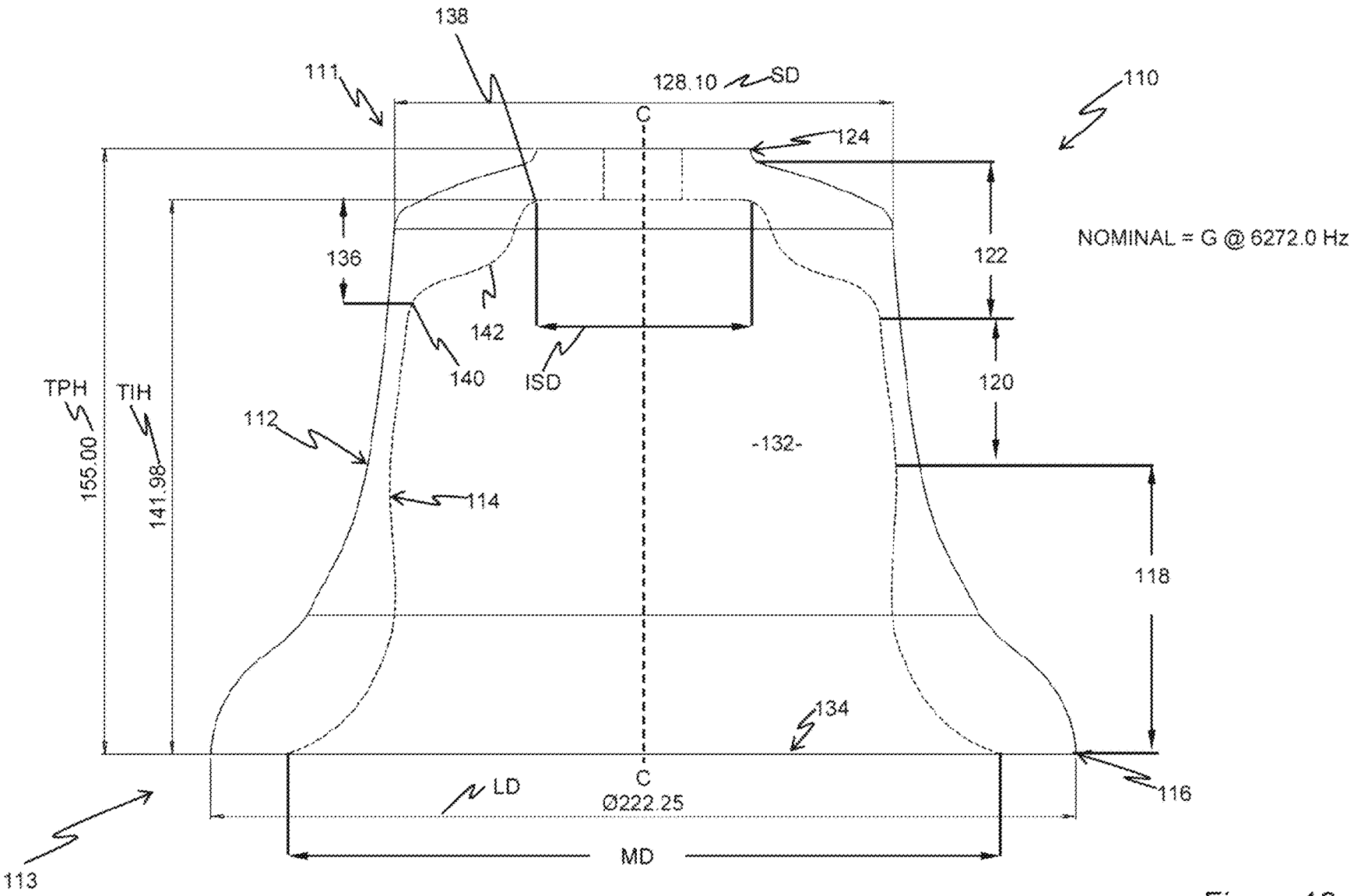
Figure 20:
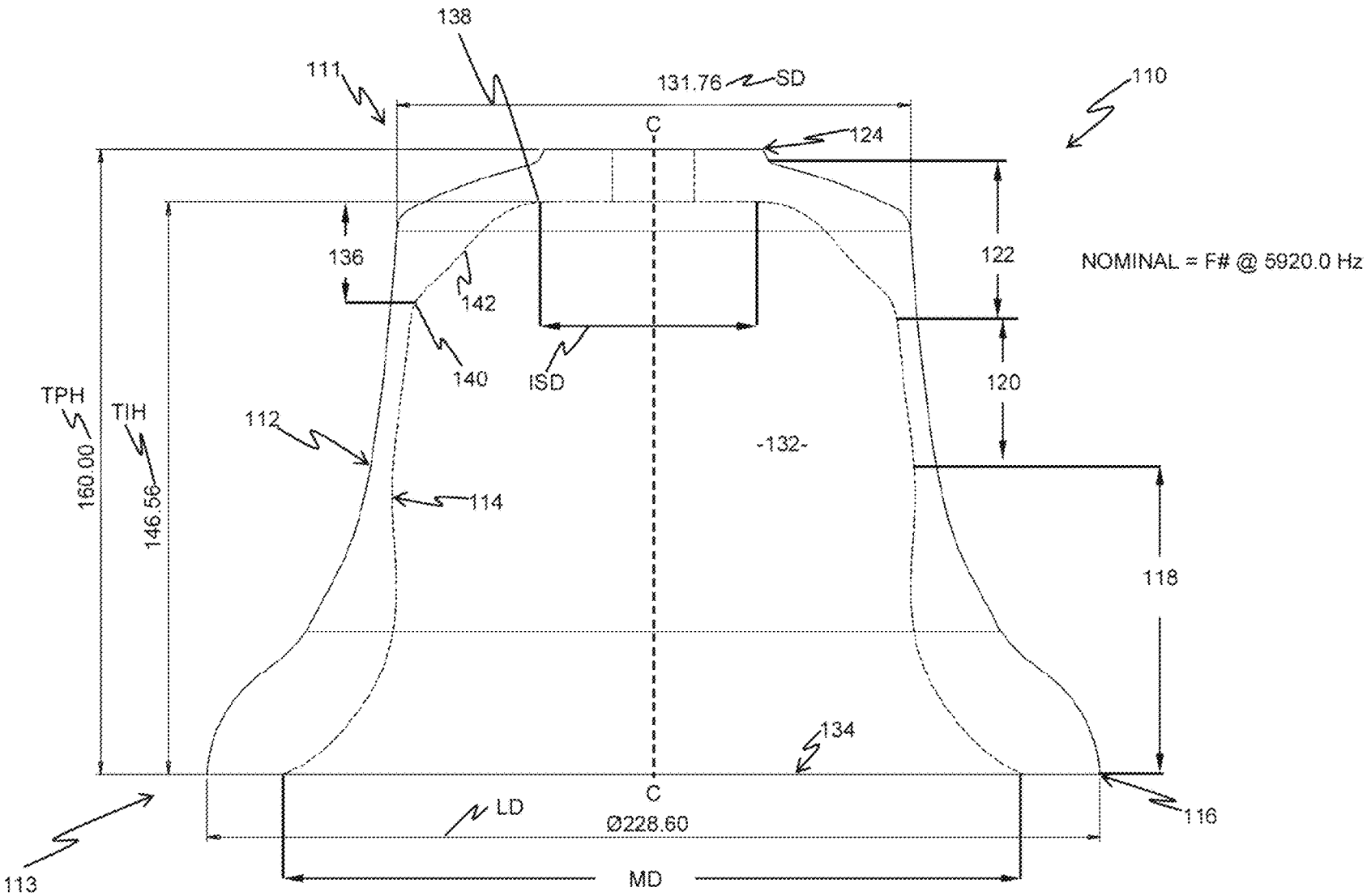
Figure 21:
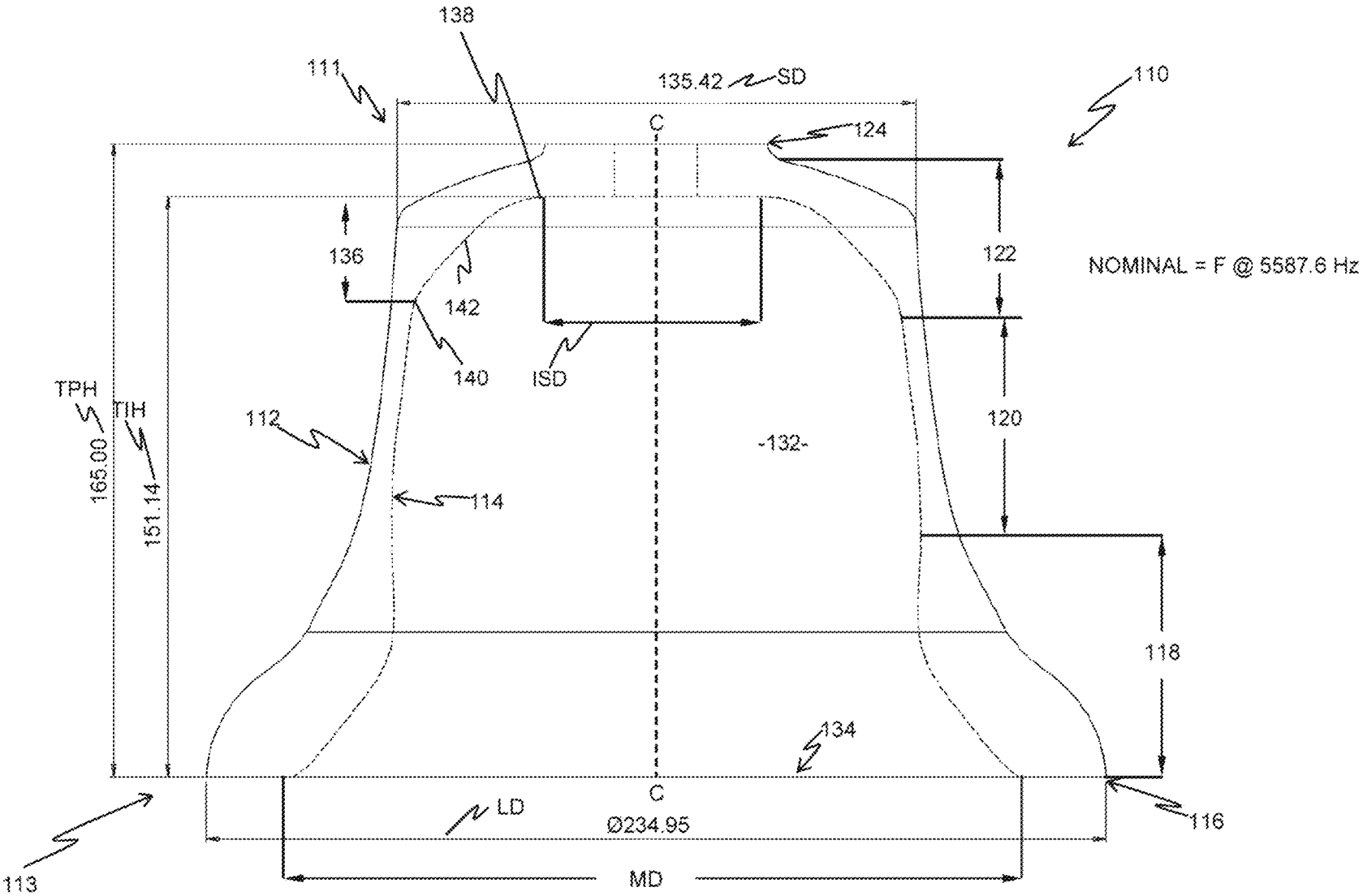
Figure 22:
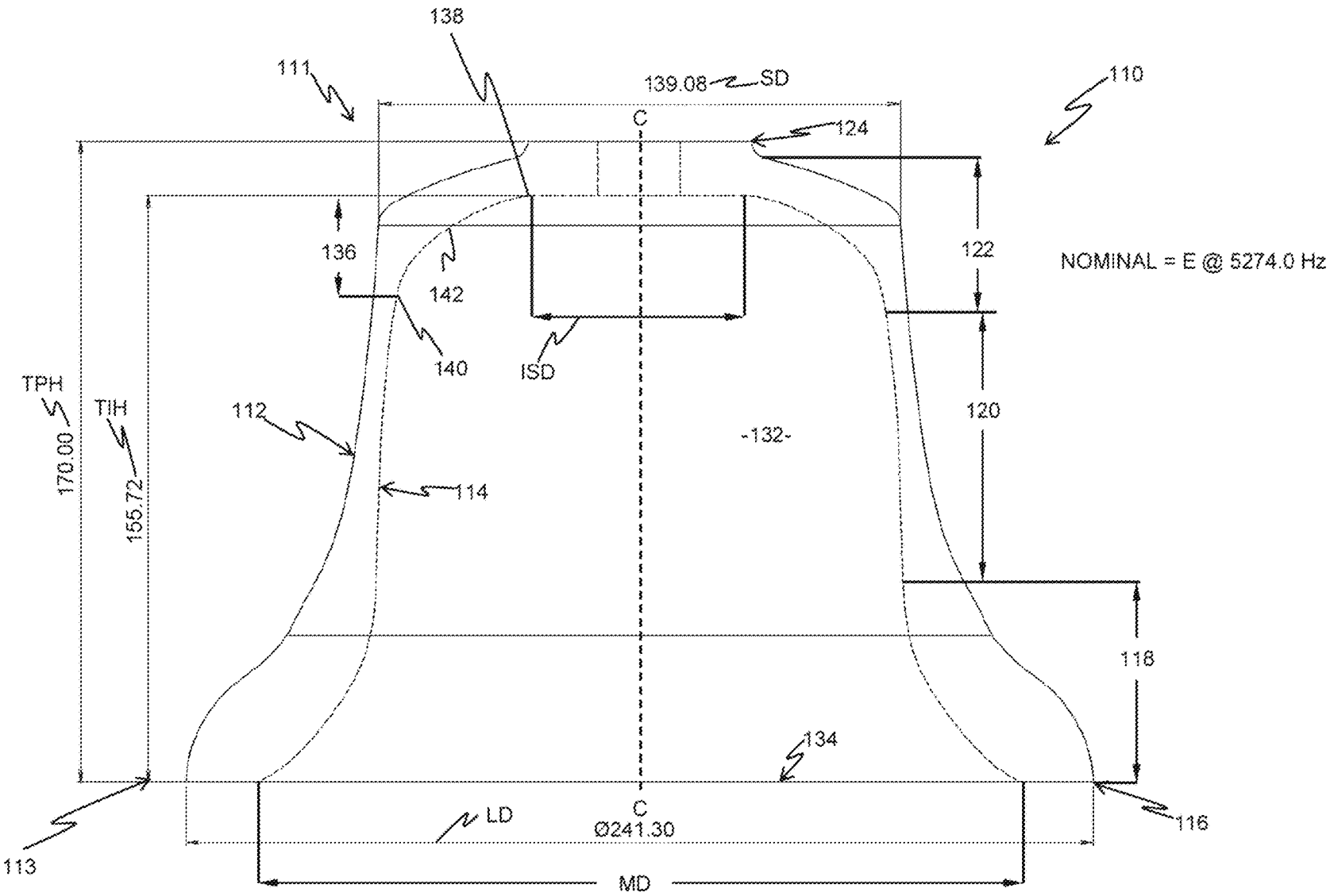
Figure 23:
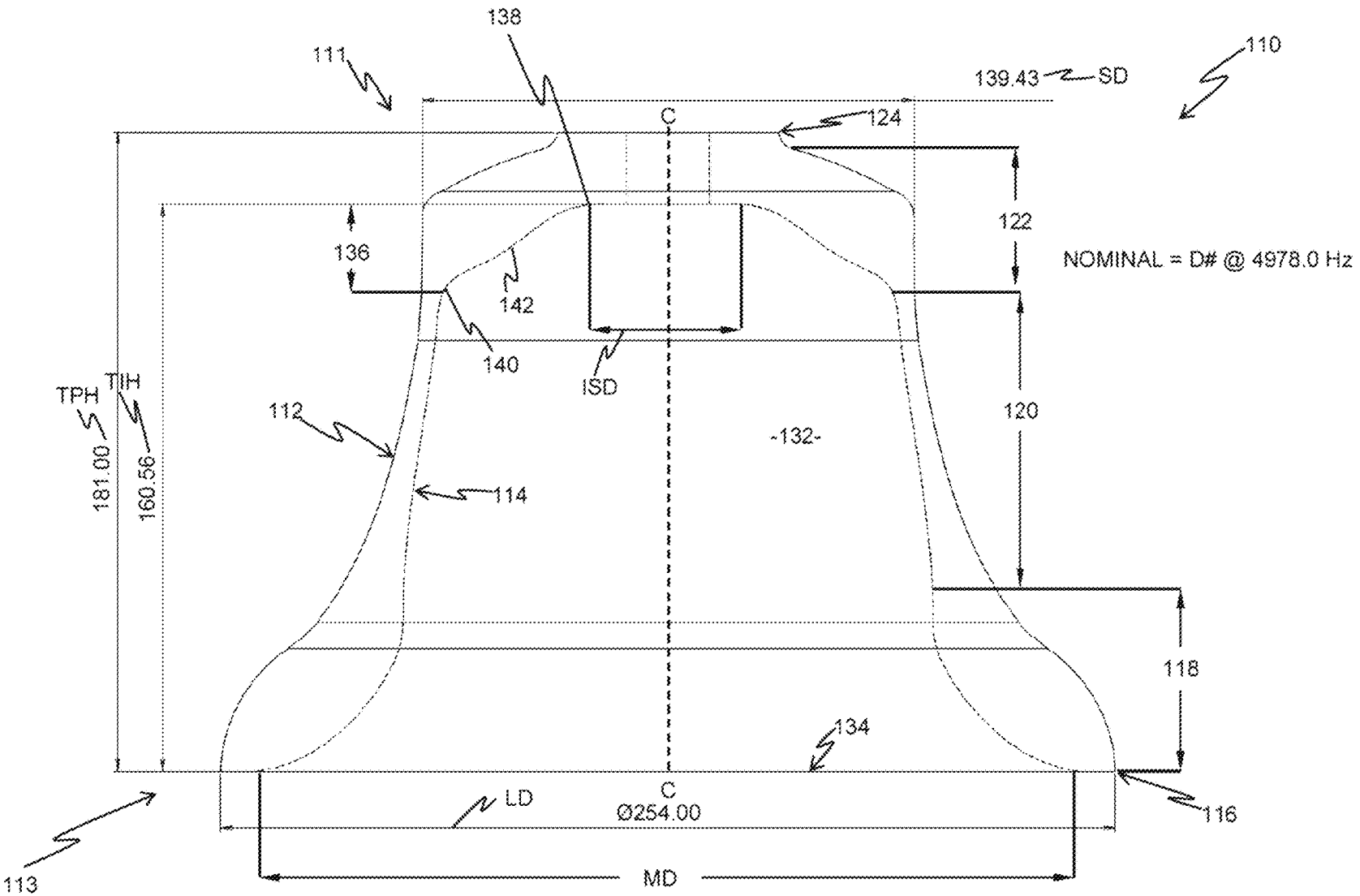
Figure 24:
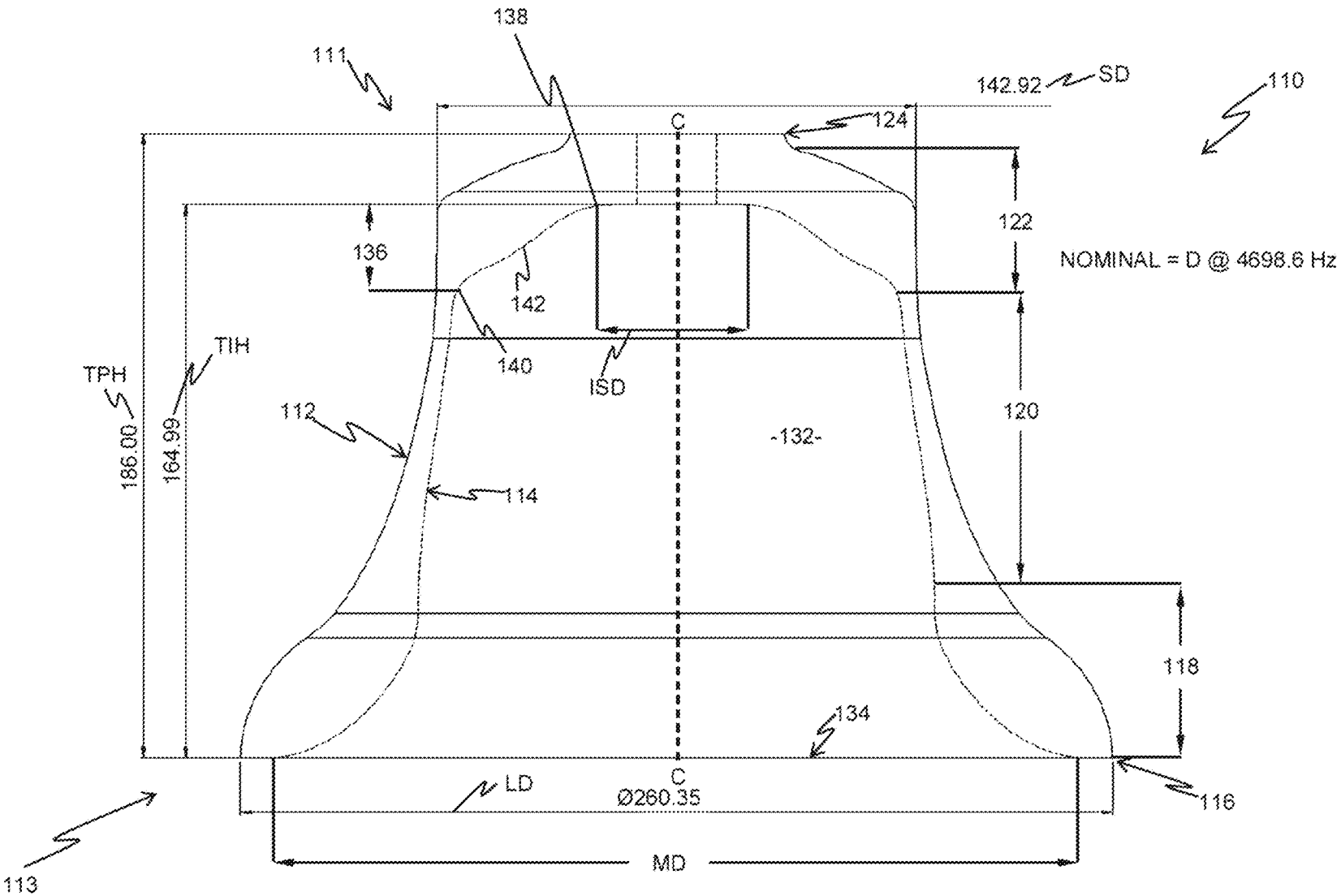
Figure 25:
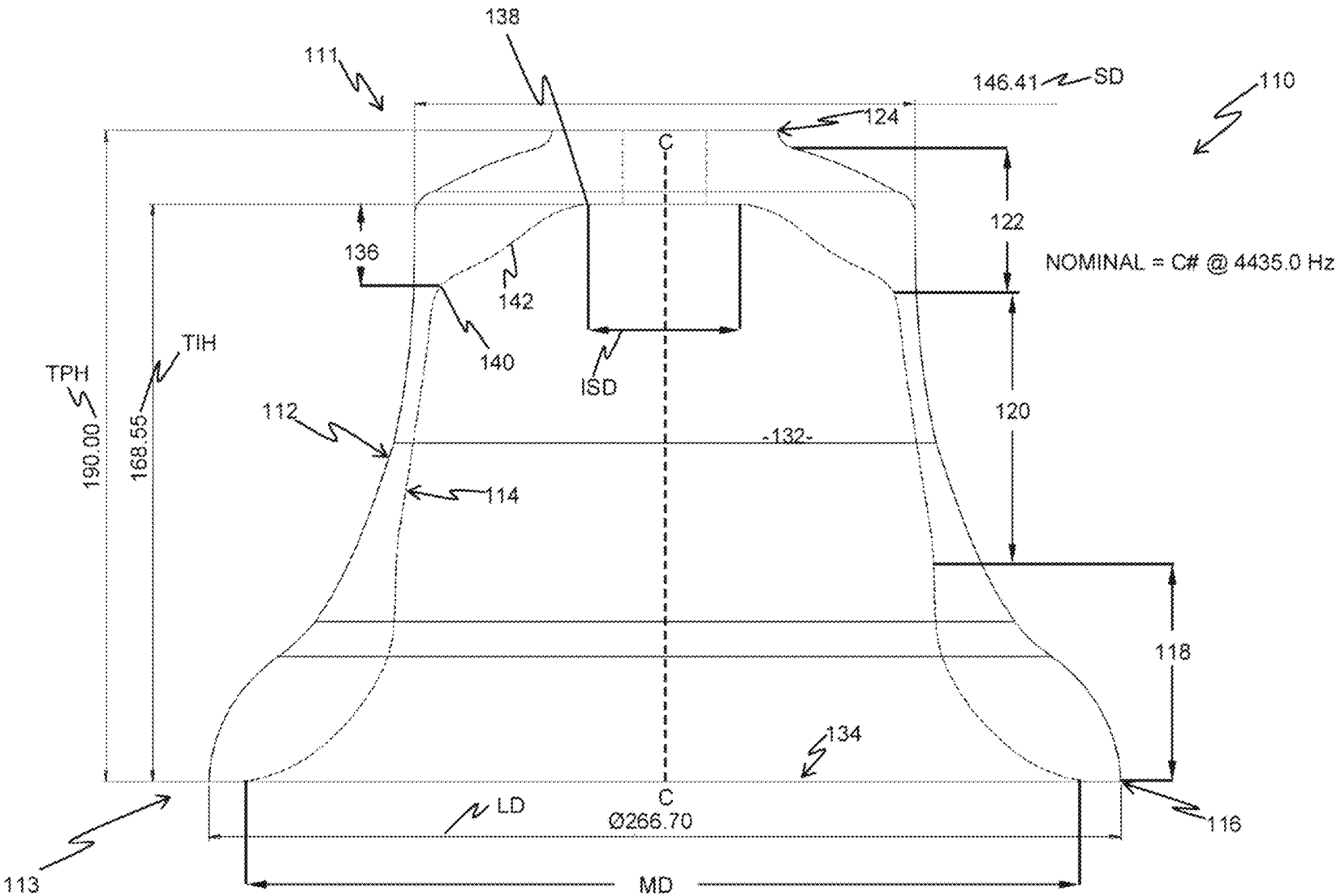
Figure 26:
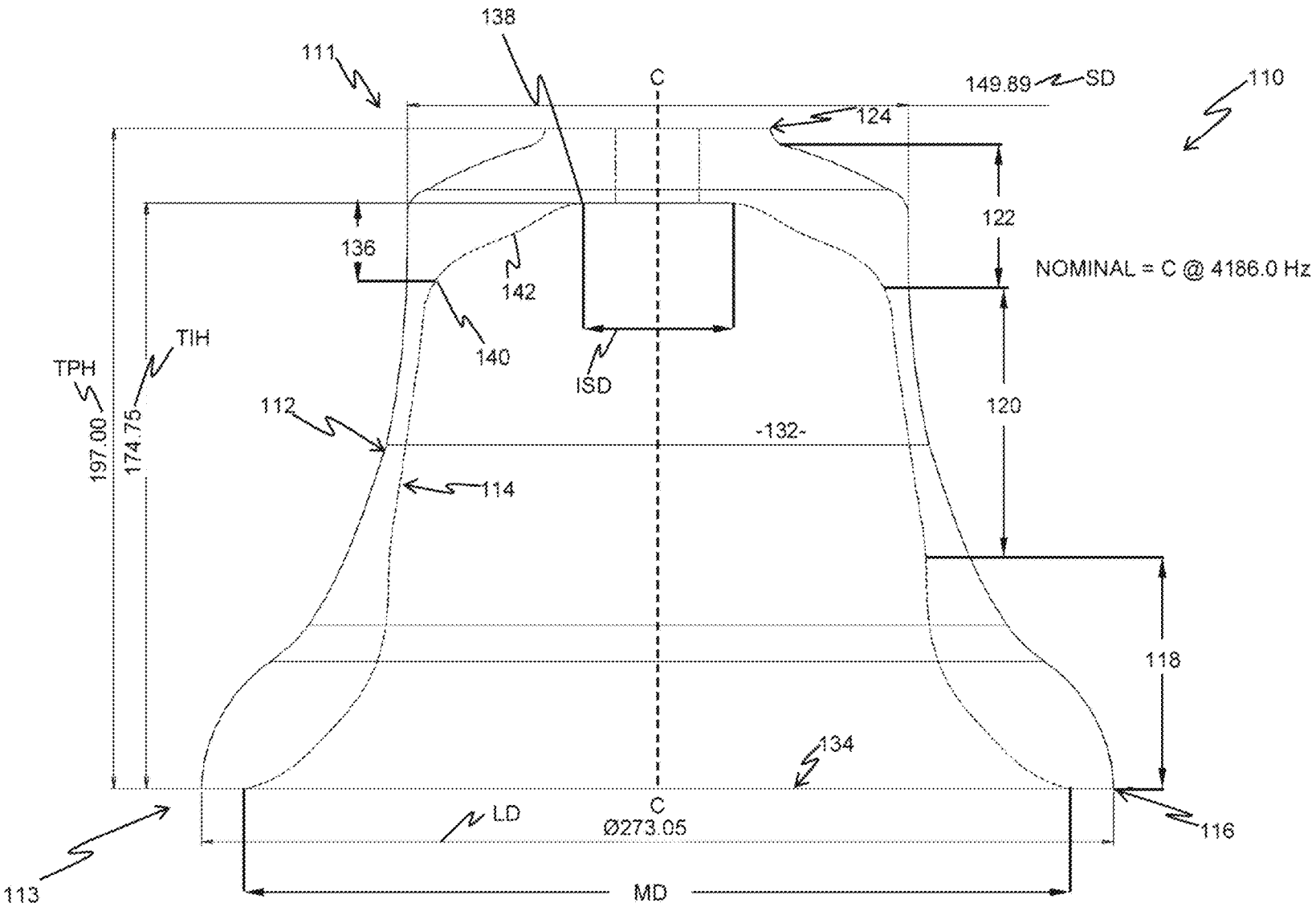
Figure 27:
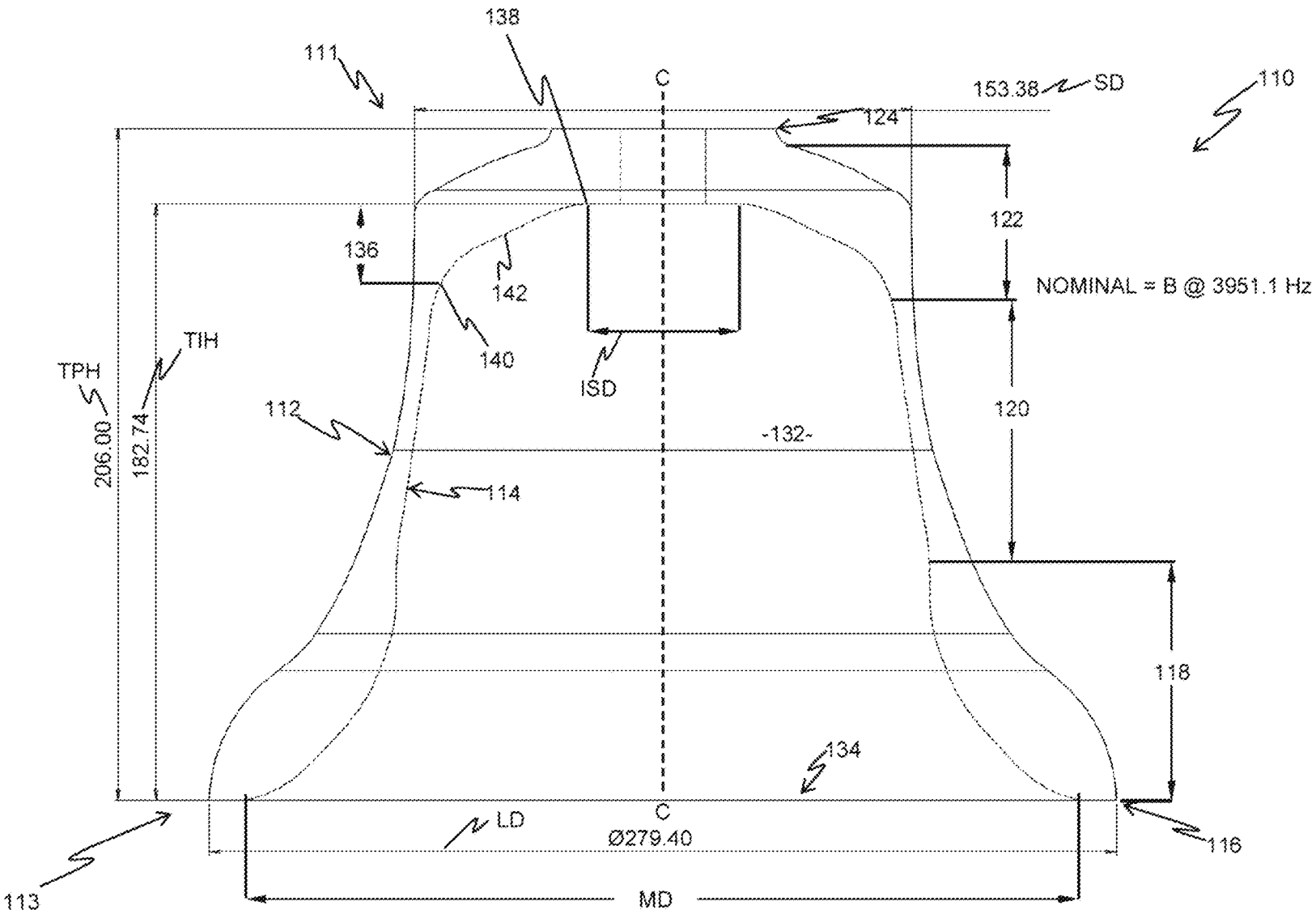
Figure 28:
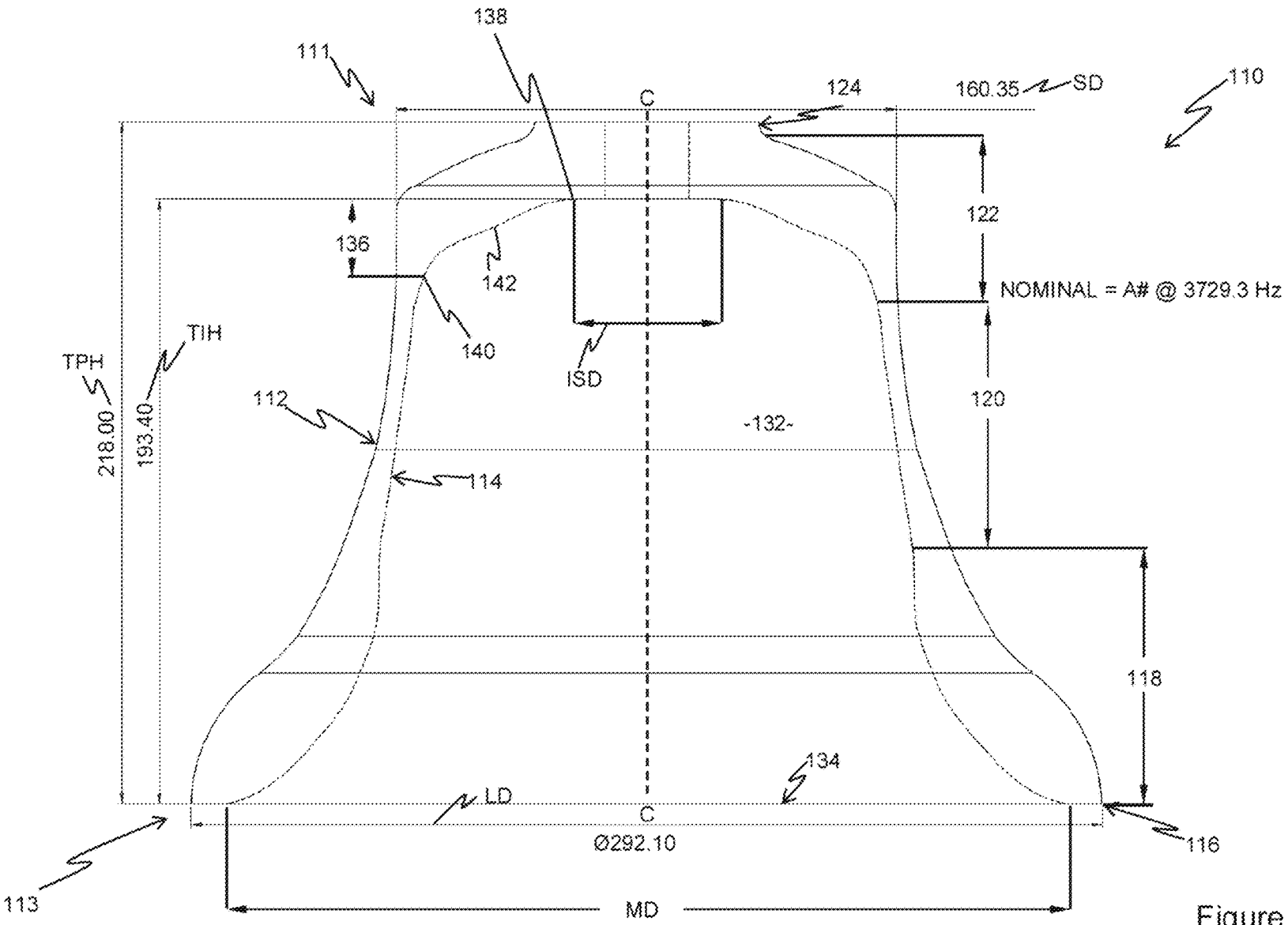
Figure 29:
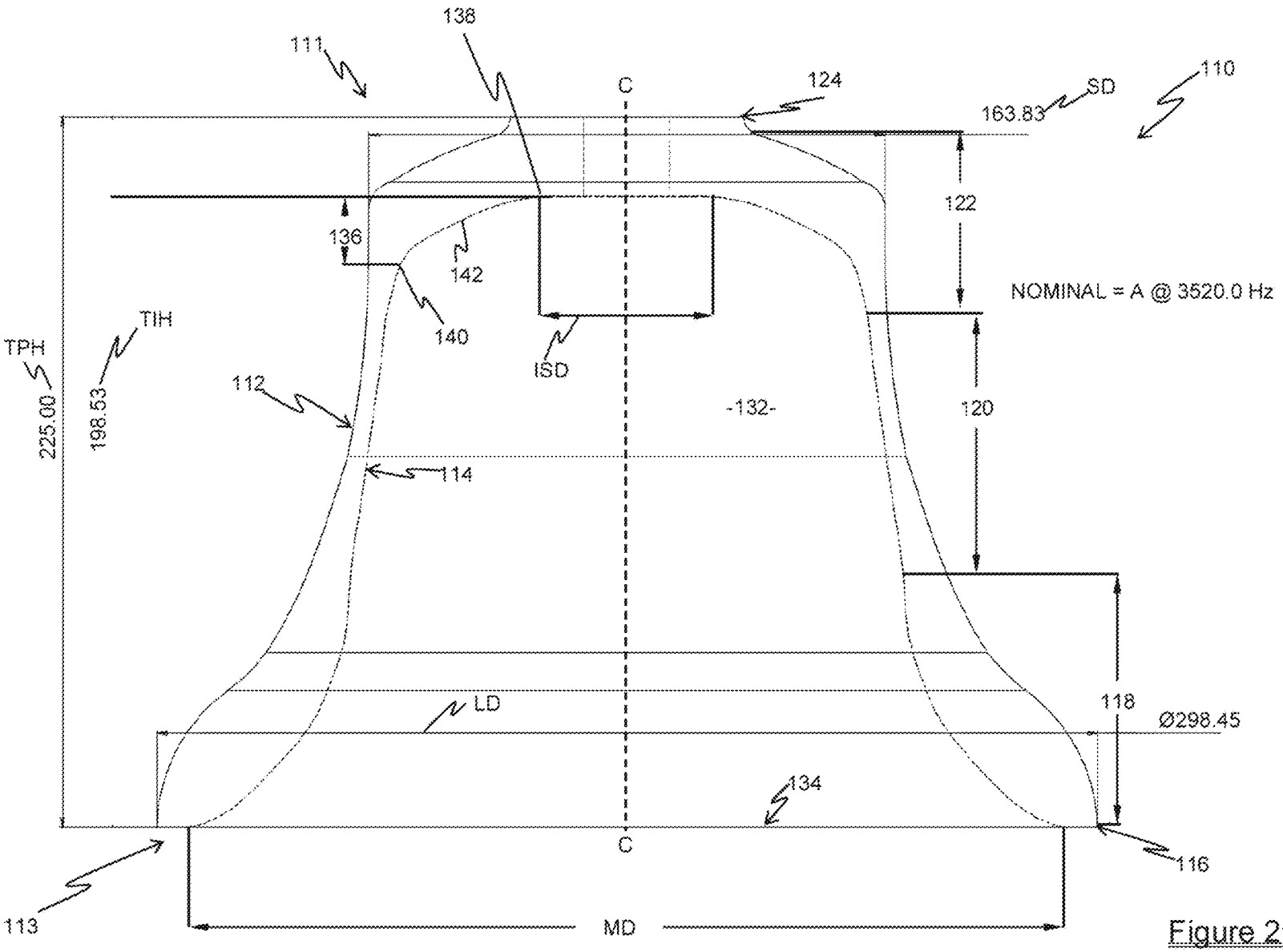
Figure 30:
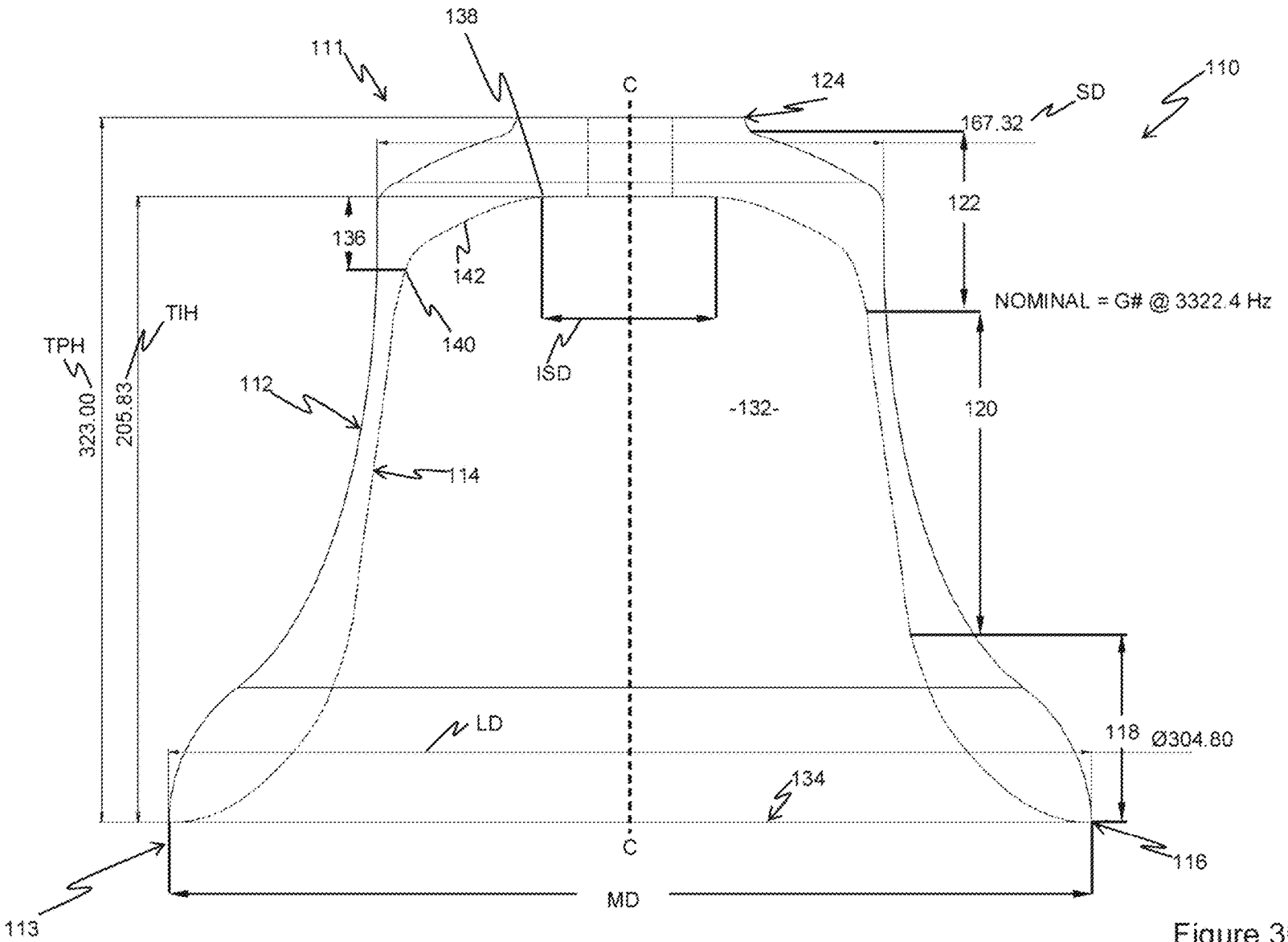
Figure 31:
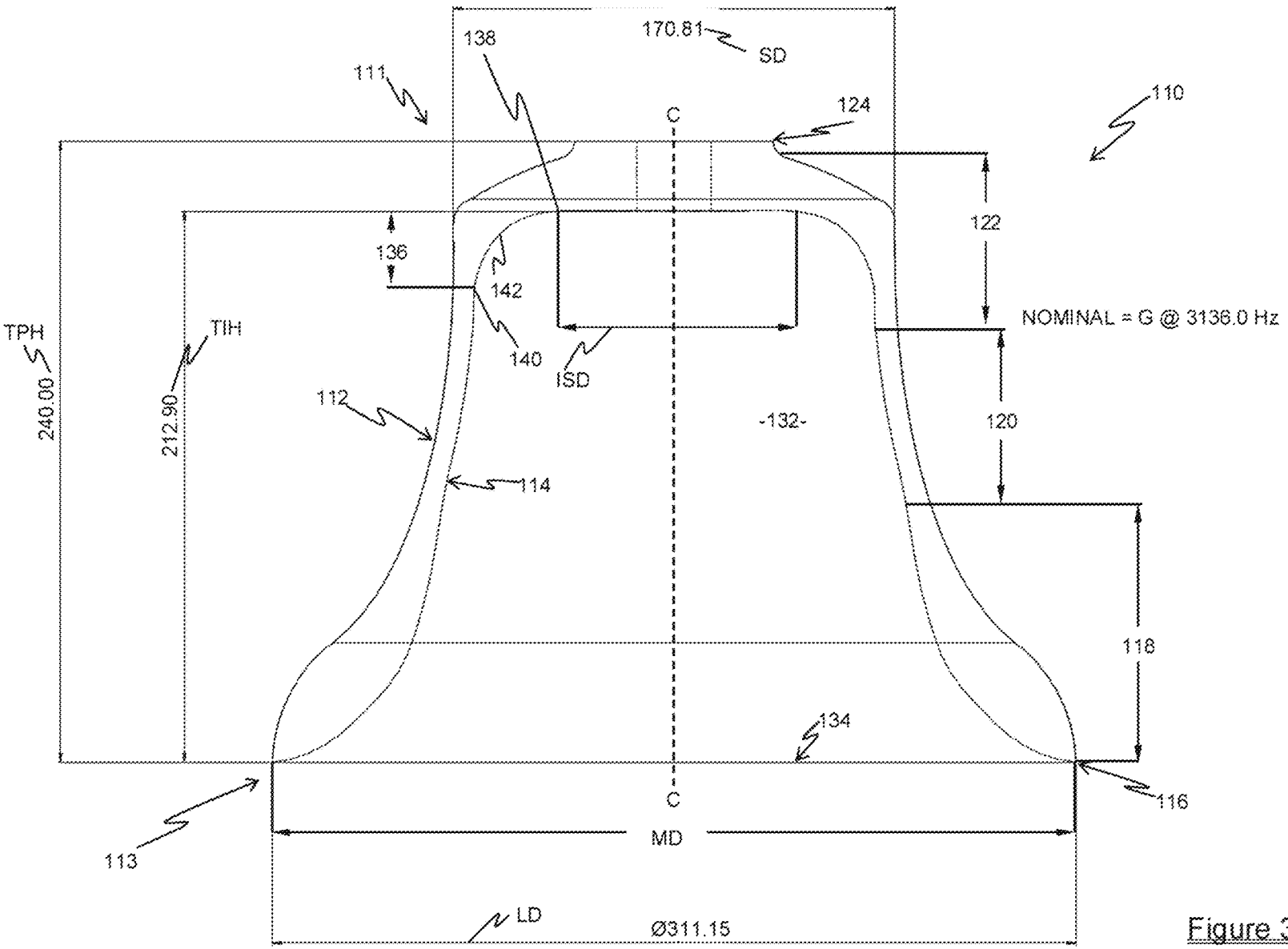
Figure 32:
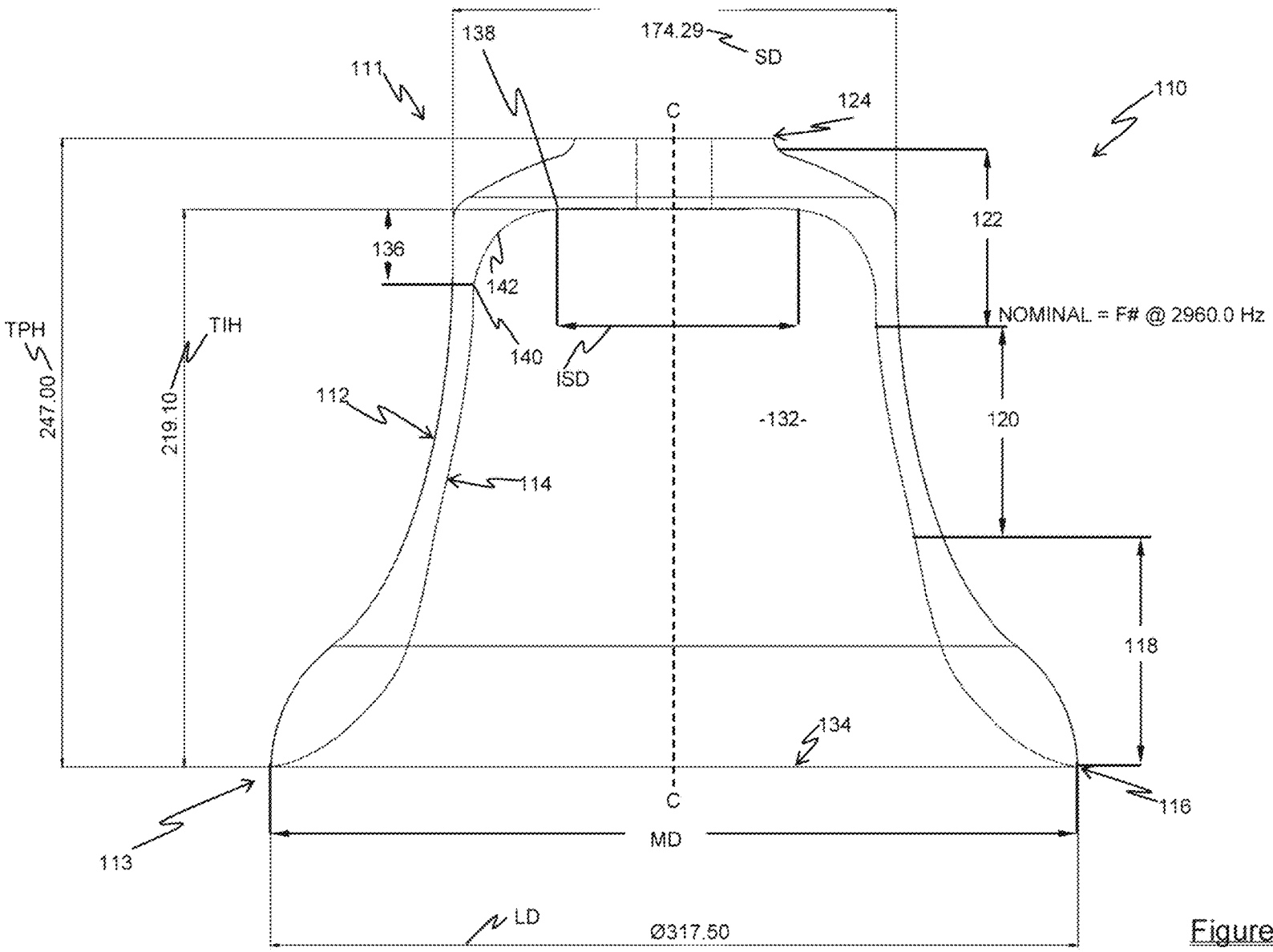
Figure 33:
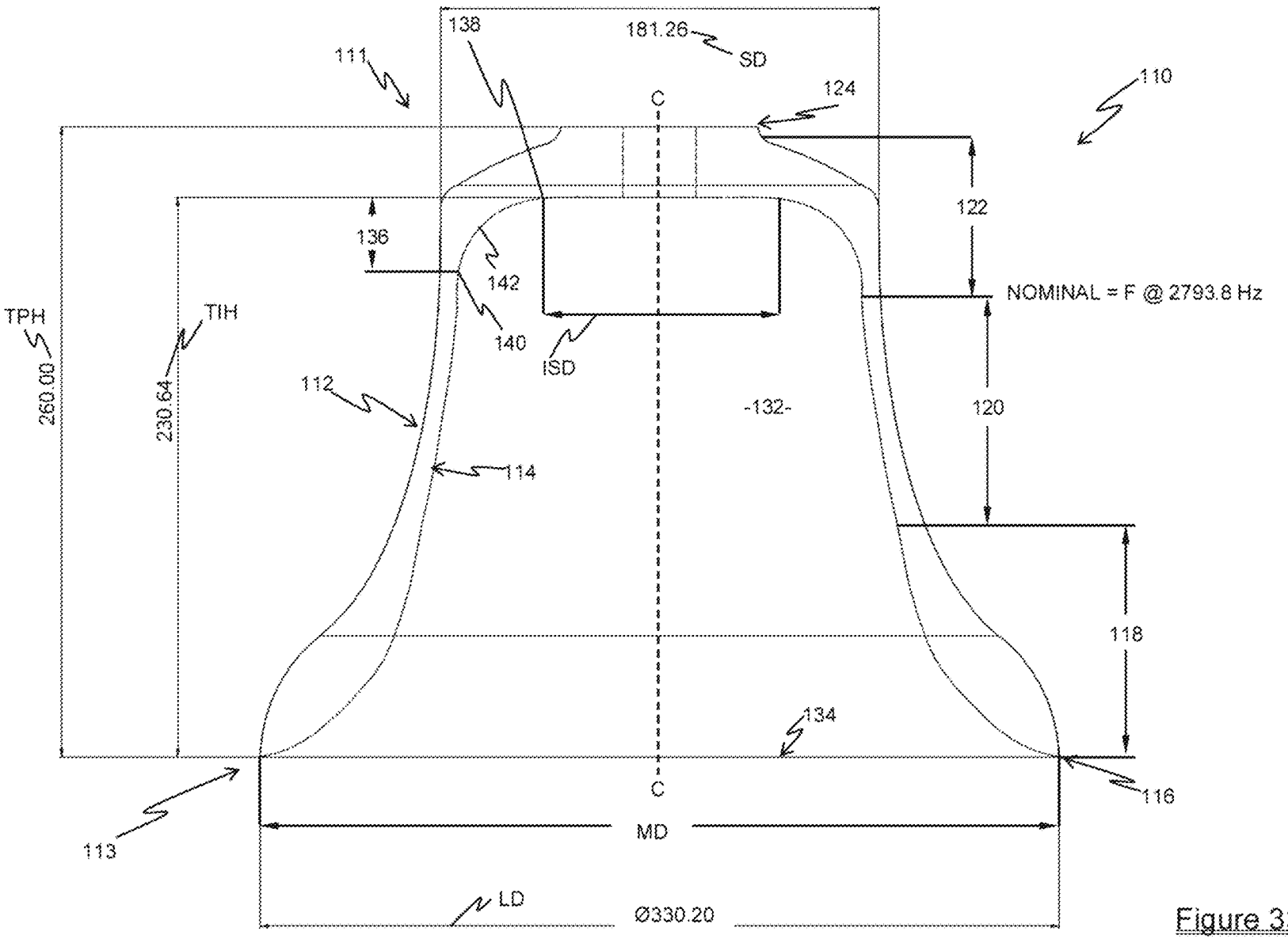
Figure 34:
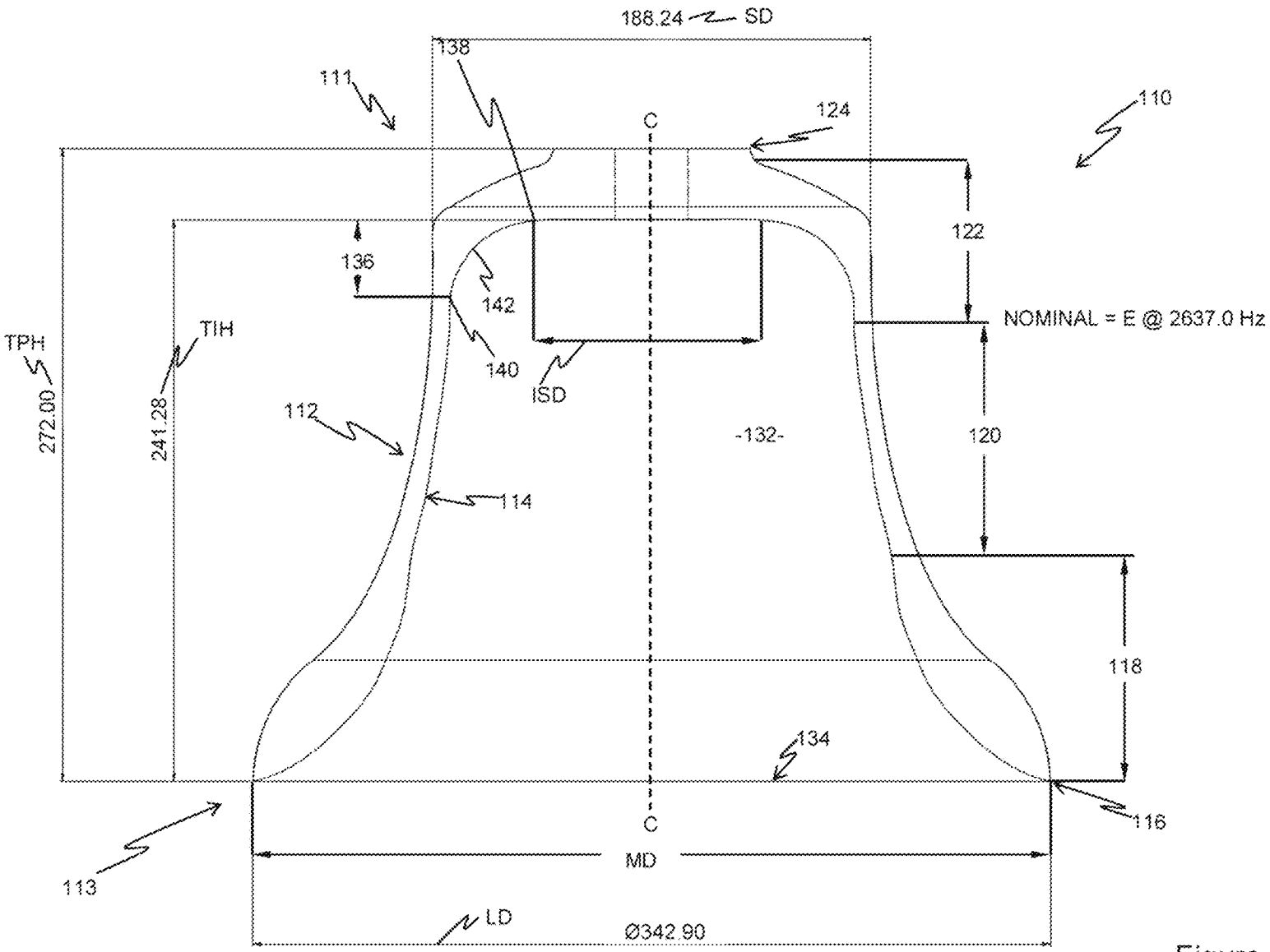
Figure 35:
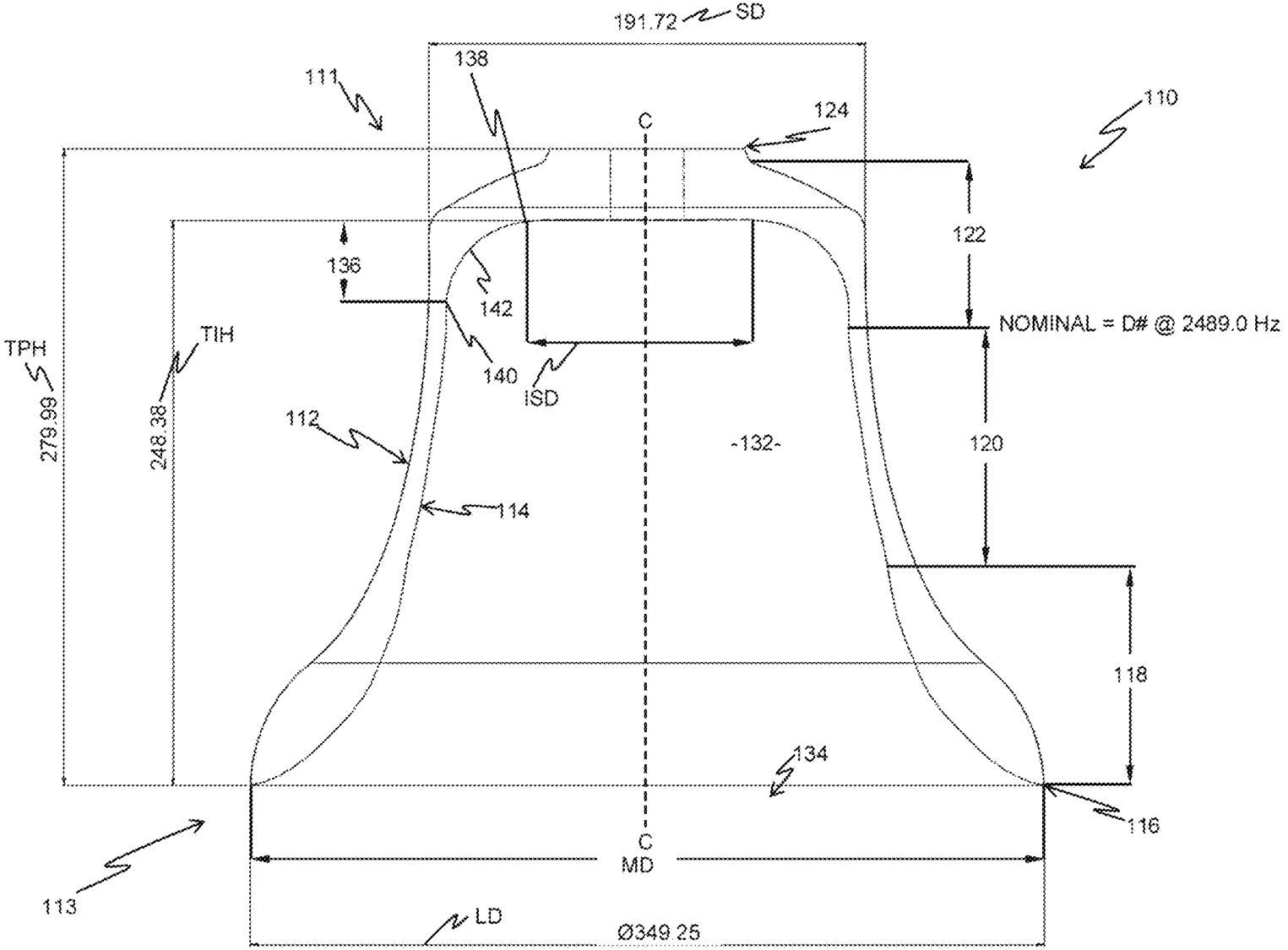
Figure 36:
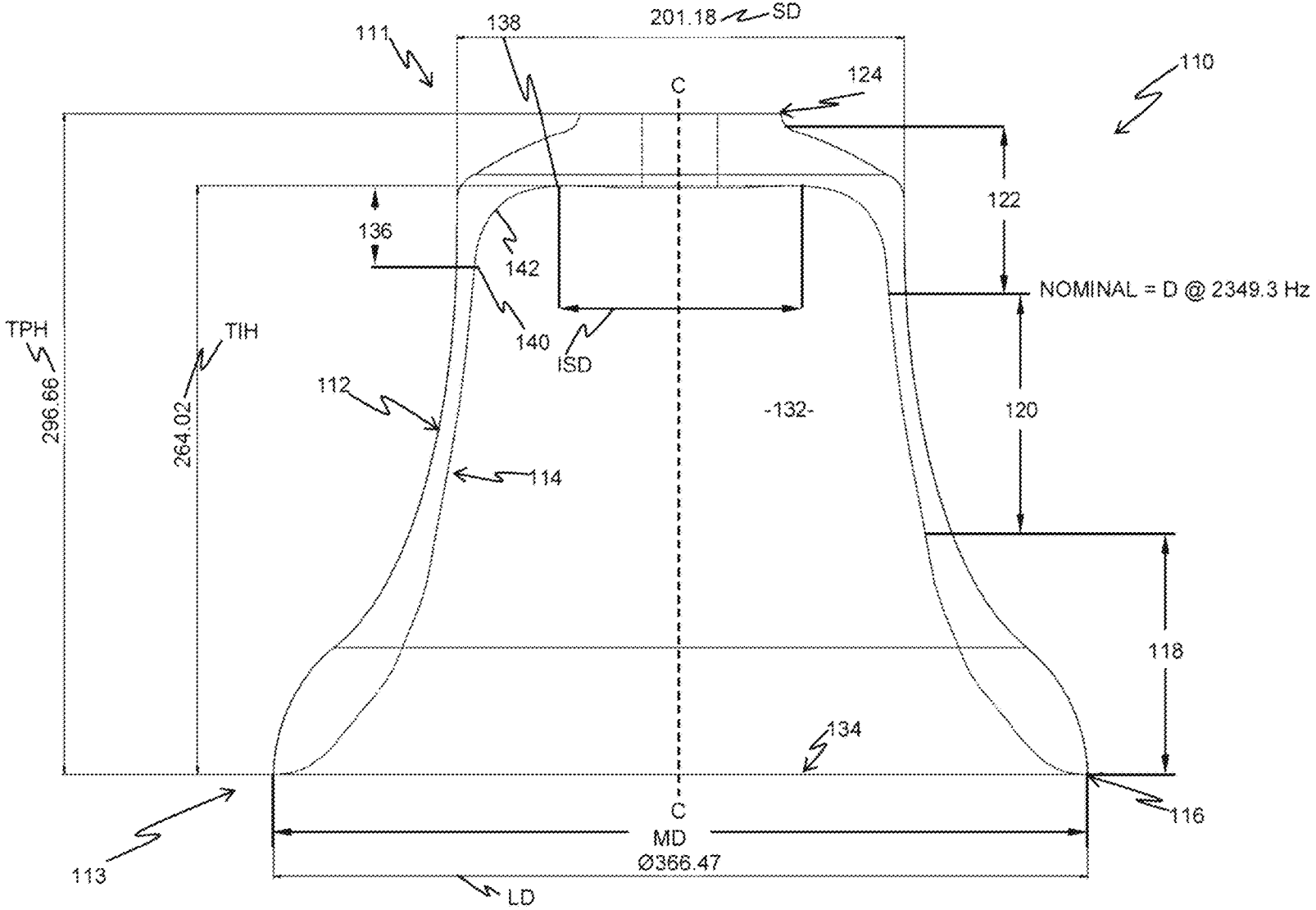

A second embodiment of a bell in accordance with the disclosure will now be described with reference to FIG. 13. Like referenced numerals are the same as for FIG. 1 with the addition of 100. FIG. 13 shows a bell 110 having the same features as described for bell 10. A portion 136 of the inside surface 114 generally adjacent the shoulder 122 has a first end 138 at or near the crown 124; a second end 140 at or near the waist 120 and a point of inflection or a midpoint 142 generally in-between the first and second ends 138, 140. As the portion 136 extends away from the first end 138 towards the point of inflection or midpoint 142 the portion 136 extends away from the crown 124 more than it extends towards the outside surface 112. Also as the portion 136 of the inside surface 114 extends towards the second end 140 from the point of inflection or midpoint 142 the portion 136 extends towards the outside surface 112 more than it extends away from the crown 124.

The inside surface 114 having the above described profile is advantageous. In particular, the above profile enables more metal to be introduced at the shoulder 122 of the bell 110. This has been found to improve the oscillation modes of the bell, and in particular the oscillation modes at the shoulder and waist of the bell. The introduction of more metal to the top of the bell also improves the amplitude characteristics of the individual frequencies within the bell and enables a user to control the growth and decay profiles of the frequencies produced by the bell 110.

The bell 110 described above may also incorporate any of the features described above.

In the present embodiment the point of inflection or midpoint 142 may be positioned substantially halfway between the first and second ends 138, 140. In particular, the portion 136 between the first end 138 and the point of inflection or midpoint 142 may extend curvilinearly away from the first end 138 inwardly away from the outside surface 112. Further, the portion 136 between the point of inflection or midpoint 142 and the second end 140 may extend curvilinearly away from the point of inflection or midpoint 142 inwardly away from the outside surface 112. Alternatively, the portion 136 between the first end 138 and the point of inflection or midpoint 142 may extend linearly away from the first end 138. The portion 136 may also between the point of inflection or midpoint 142 and the second end 140 extend linearly away from the point of inflection or midpoint 142, in an alternative embodiment.

The point of inflection or midpoint 142 may form a convex inside surface 114. The inside surface may be convex about the point of inflection or midpoint 142. Including such shape features can be used to control the fundamental frequency to provide a particularly pleasant sounding bell.

A thickness of the shoulder 124, measured on a horizontal axis from the outside surface 112 to the inside surface 114 in a direction generally perpendicular to the central axis C of the bell 110, may be at least: 10%; 12%; 14%; 16%; 18%; 20%; 22%; or 24% of the shoulder diameter; and/or at most: 30%; 28%; 26%; or 24% of the shoulder diameter.

In bells having the portion 136 it has been found that it can be additionally advantageous for the shoulder diameter (SD) to be equal to SD=0.55*LD ±5% (measurements in mm). In particular, including such amounts of metal in such shapes can control the fundamental frequency to provide a particularly pleasant sounding bell.

In bells having the portion 136 it has also been found that it can be additionally advantageous for a thickness of the shoulder, measured on a horizontal axis from the outside surface to a central axis of the bell passing through the point of inflection to be at least 10% of the shoulder diameter. The thickness may alternatively be at least 12%; 14%; 16%; 18%; 20%; 22%; or 24% of the shoulder diameter. In particular, including such amounts of metal in such shapes can control the fundamental frequency to provide a particularly pleasant sounding bell.

Further, including amounts of metal in such shapes and thicknesses in combination with the portion 136 may be particularly advantageous in the production of smaller bells. For example, in bells having a lip diameter of at most: 420 mm; 400 mm; 380 mm; 250 mm; 245 mm; or 240 mm. In particular, such features can be used to control of the fundamental frequency to provide a particularly pleasant sounding small bell.

Below we provide dimensions for a first set of bells in accordance with the present disclosure:

TABLE 1

| Lip diameter (mm) | TPH (mm) | TPH − crown height (mm) | Crown height (mm) | Shoulder diameter (mm) |
|---|---|---|---|---|
| 266.70 | 191.00 | 175.60 | 15.40 | 146.41 |
| 279.40 | 201.00 | 184.79 | 16.21 | 153.38 |

TABLE 1-continued

| Lip diameter (mm) | TPH (mm) | TPH − crown height (mm) | Crown height (mm) | Shoulder diameter (mm) |
|---|---|---|---|---|
| 285.75 | 207.00 | 190.30 | 16.70 | 156.86 |
| 292.10 | 212.00 | 194.90 | 17.10 | 160.35 |
| 304.80 | 222.00 | 204.09 | 17.91 | 167.32 |
| 317.50 | 233.00 | 214.20 | 18.80 | 174.29 |
| 330.20 | 243.00 | 223.40 | 19.60 | 181.26 |
| 342.90 | 253.00 | 232.59 | 20.41 | 188.24 |
| 355.60 | 264.00 | 242.71 | 21.29 | 195.21 |
| 368.30 | 274.00 | 251.90 | 22.10 | 202.18 |
| 387.35 | 289.00 | 265.69 | 23.31 | 212.64 |
| 400.05 | 300.00 | 275.80 | 24.20 | 219.61 |

Below we provide dimensions for a second set of bells in accordance with the disclosure:

TABLE 2

| Lip diameter (mm) | TPH (mm) | TPH − crown height (mm) | Shoulder diameter (mm) |
|---|---|---|---|
| 184.15 | 131.23 | 120.20 | 106.14 |
| 190.50 | 129.00 | 118.16 | 109.80 |
| 196.85 | 134.00 | 122.75 | 113.46 |
| 203.20 | 139.00 | 127.32 | 117.12 |
| 209.55 | 145.00 | 132.82 | 120.78 |
| 215.90 | 150.00 | 137.40 | 124.44 |
| 222.25 | 155.00 | 141.98 | 128.10 |
| 228.60 | 160.00 | 146.56 | 131.76 |
| 234.95 | 165.00 | 151.14 | 135.42 |
| 241.30 | 170.00 | 155.72 | 139.08 |
| 254.00 | 181.00 | 160.56 | 139.43 |
| 266.70 | 190.00 | 168.55 | 146.41 |
| 260.35 | 186.00 | 164.99 | 142.92 |
| 273.05 | 197.00 | 174.75 | 149.89 |
| 279.40 | 206.00 | 182.74 | 153.38 |
| 292.10 | 218.00 | 193.40 | 160.35 |
| 298.45 | 225.00 | 198.53 | 163.83 |
| 304.80 | 232.00 | 205.83 | 167.32 |
| 311.15 | 240.00 | 212.90 | 170.81 |
| 317.50 | 247.00 | 219.10 | 174.29 |
| 330.20 | 260.00 | 230.64 | 181.26 |
| 342.90 | 272.00 | 241.28 | 188.24 |
| 349.25 | 279.99 | 248.38 | 191.72 |
| 366.47 | 296.66 | 264.02 | 201.18 |

The bells may be designed using CAD software, such as SolidWorks. A design for a bell may be stored as a CAD file. Alternatively, or in addition, a design for a bell may be stored as a PDF file.

We also provide a plurality of bells where each of the bells is in accordance with the disclosure.

Figure 38:
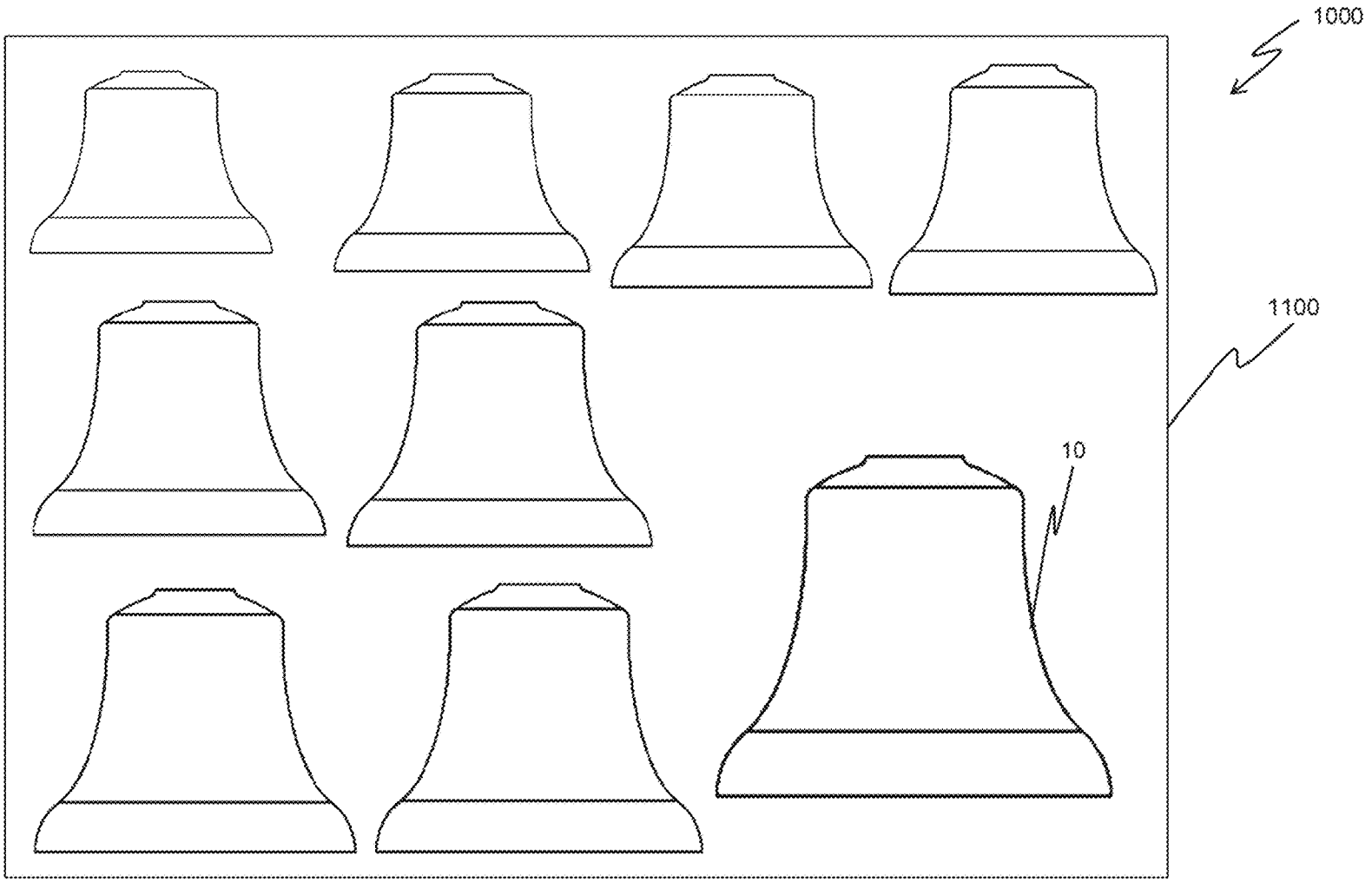
FIG. 38 shows a carillon including bells as shown in FIGS. 1 to 36.

A carillon 1000 may be made in accordance with the present disclosure, as shown in FIG. 38. The carillon may include a body 1100 for supporting bells therefrom. The carillon 1000 may include at least one bell in accordance with the present disclosure.

The carillon 1000 may also be made in accordance with the present disclosure by including a plurality of bells in accordance with the present disclosure.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

Although certain example embodiments of the invention have been described, the scope of the appended claims is not intended to be limited solely to these embodiments. The claims are to be construed literally, purposively, and/or to encompass equivalents.

The invention claimed is:

1. A bell including:

an outside surface which defines an exterior of the bell;

an inside surface which defines an interior of the bell;

a lip positioned at a bottom of the bell;

a sound bow positioned above the lip;

a waist positioned above the sound bow;

a shoulder positioned above the waist, having a shoulder diameter; and a crown positioned at a top of the bell above the shoulder;

wherein a portion of the inside surface generally adjacent the shoulder has a first end at or near the crown; a second end at or near the waist and a point of inflection generally in-between the first and second ends;

wherein as the portion of the inside surface extends away from the first end towards the point of inflection the portion extends away from the crown more than it extends towards the outside surface;

wherein as the portion of the inside surface extends towards the second end from the point of inflection the portion extends towards the outside surface more than it extends away from the crown;

and wherein the shoulder diameter (SD) is equal to:

$$SD=0.55*LD \pm 5\%.$$

2. A bell according to claim 1 wherein the point of inflection is positioned substantially halfway between the first and second ends.

3. A bell according to claim 1 wherein the portion between the first end and the point of inflection extends curvilinearly away from the first end inwardly away from the outside surface.

4. A bell according to claim 1 wherein the portion between the point of inflection and the second end extends curvilinearly away from the point of inflection inwardly away from the outside surface.

5. A bell according to claim 1 wherein the portion between the first end and the point of inflection extends linearly away from the first end.

6. A bell according to claim 1 wherein the portion between the point of inflection and the second end extends linearly away from the point of inflection.

7. A bell according to claim 1 wherein the shoulder has a shoulder diameter; and wherein a thickness of the shoulder, measured on a horizontal axis from the outside surface to a central axis of the bell, is at least:

10%;

12%;

14%;

16%;

18%;

20%;

22%; or

24% of the shoulder diameter; and/or at most:

30%;

28%;

26%; or

24% of the shoulder diameter.

8. A bell according to claim 7 wherien the horizontal axis passes through the point of inflection.

9. A bell including:

an outside surface which defines an exterior of the bell;

an inside surface which defines an interior of the bell;

a lip positioned at a bottom of the bell;

a sound bow positioned above the lip;

a waist positioned above the sound bow;

a shoulder positioned above the waist; and a crown positioned at a top of the bell above the shoulder;

wherein a portion of the inside surface generally adjacent the shoulder has a first end at or near the crown; a second end at or near the waist and a point of inflection generally in-between the first and second ends;

wherein as the portion of the inside surface extends away from the first end towards the point of inflection the portion extends away from the crown more than it extends towards the outside surface;

wherein as the portion of the inside surface extends towards the second end from the point of inflection the portion extends towards the outside surface more than it extends away from the crown;

and wherein a thickness of the shoulder, measured on a horizontal axis from the outside surface to a central axis of the bell passing through the point of inflection is at least 10% of the shoulder diameter.

10. A bell according to claim 9 wherein the point of inflection is positioned substantially halfway between the first and second ends.

11. A bell according to claim 9 wherein the portion between the first end and the point of inflection extends curvilinearly away from the first end inwardly away from the outside surface.

12. A bell according to claim 9 wherein the portion between the point of inflection and the second end extends curvilinearly away from the point of inflection inwardly away from the outside surface.

13. A bell according to claim 9 wherein the portion between the first end and the point of inflection extends linearly away from the first end.

14. A bell according to claim 9 wherein the portion between the point of inflection and the second end extends linearly away from the point of inflection.

15. A carillon including one or more bells in accordance with claim 1.

16. A carillon including one or more bells in accordance with claim 9.

* * * * *